US012357113B2

(12) United States Patent
Walper

(10) Patent No.: US 12,357,113 B2
(45) Date of Patent: Jul. 15, 2025

(54) SERVING STADIUM

(71) Applicant: Jeffrey G. Walper, Macomb, MI (US)

(72) Inventor: Jeffrey G. Walper, Macomb, MI (US)

( * ) Notice: Subject to any disclaimer, the term of this patent is extended or adjusted under 35 U.S.C. 154(b) by 0 days.

(21) Appl. No.: 18/396,536

(22) Filed: Dec. 26, 2023

(65) Prior Publication Data

US 2024/0237835 A1 Jul. 18, 2024

Related U.S. Application Data

(63) Continuation of application No. 17/868,019, filed on Jul. 19, 2022, now Pat. No. 11,849,866, which is a continuation of application No. 16/730,148, filed on Dec. 30, 2019, now Pat. No. 11,389,013.

(60) Provisional application No. 62/786,516, filed on Dec. 30, 2018.

(51) Int. Cl.

| | |
|---|---|
| ***A47F 3/00*** | (2006.01) |
| ***A47F 3/06*** | (2006.01) |
| ***A47F 5/00*** | (2006.01) |
| ***A47F 5/10*** | (2006.01) |
| ***A47F 7/00*** | (2006.01) |
| ***A47F 7/14*** | (2006.01) |

(52) U.S. Cl.

CPC ..... *A47F 3/004* (2013.01); *A47F 3/06* (2013.01); *A47F 5/0062* (2013.01); *A47F 5/101* (2013.01); *A47F 7/0071* (2013.01); *A47F 7/145* (2013.01); *A47F 2005/0075* (2013.01)

(58) Field of Classification Search

CPC ..... A47F 3/004; A47F 5/101; A47F 5/0062; A47F 3/06; A47F 7/0071; A47F 5/11; A47F 5/14; A47F 5/114; A47F 5/116; A47F 7/145; A47F 2005/0075; A47B 47/00; A47B 55/06; A47G 19/12; A47G 19/30; A47G 21/00; A47G 23/00; A47G 2021/022; A47G 2023/0658; B65D 5/526; B65D 5/5266

USPC ..... 211/85.4, 55, 72, 128.1, 130.1, 126.16; 108/92, 180; 206/740–744; D7/506, D7/551.1

See application file for complete search history.

(56) References Cited

U.S. PATENT DOCUMENTS

| | | | | | |
|---|---|---|---|---|---|
| 296,367 | A * | 4/1884 | Toay | B65D 5/5213 | 206/740 |
| 839,438 | A * | 12/1906 | Turner, Jr. | B65D 5/5213 | 206/740 |
| 861,934 | A * | 7/1907 | Barnea | B65D 5/5213 | 206/740 |
| 861,935 | A * | 7/1907 | Barnea | B65D 5/5213 | 206/740 |
| 965,019 | A * | 7/1910 | Schandein et al. | B65D 5/5266 | 206/45.3 |
| 1,335,397 | A * | 3/1920 | John | A47F 3/145 | 206/740 |
| 1,845,564 | A * | 2/1932 | Sherman | B65D 5/5213 | 206/740 |
| 1,903,936 | A * | 4/1933 | Nunnery | A47F 7/146 | 211/69.5 |
| 1,925,673 | A * | 9/1933 | Potter | A47F 5/116 | 108/100 |

(Continued)

*Primary Examiner* — Jennifer E. Novosad

(57) ABSTRACT

A display capable of being constructed from panels, shelving, racks, fixtures, endcaps, stands, or other implements. The display may include planar panels capable of being folded and assembled into a serving stadium having a tiered structure for displaying food and other items.

20 Claims, 22 Drawing Sheets

(56) References Cited

U.S. PATENT DOCUMENTS 1,927,171 A * 9/1933 Horwath ..... A47F 5/112 211/72
1,931,521 A * 10/1933 Ziemmerman ..... A47F 5/112 108/100
2,109,255 A * 2/1938 Mapson ..... A47F 5/0062 312/140.3
2,110,934 A * 3/1938 Kanty ..... A47F 5/112 206/740
2,115,048 A * 4/1938 Stewart ..... A47F 3/0439 D6/675.3
2,135,093 A * 11/1938 Abrams ..... B65D 5/5266 248/152
2,430,166 A * 11/1947 Fish ..... A47F 5/112 211/130.1
2,518,779 A * 8/1950 Hennessey ..... B65D 5/5266 206/45.3
2,528,838 A * 11/1950 Martino ..... A47F 7/02 108/101
2,914,184 A * 11/1959 Dgetluck ..... A47F 5/112 211/72
3,120,826 A * 2/1964 Bowers ..... A47B 96/02 312/257.1
3,141,555 A * 7/1964 Funke ..... G09F 5/00 211/135
3,438,508 A * 4/1969 Kuns ..... A47F 5/116 211/126.16
3,564,790 A * 2/1971 Rehfeld ..... E04F 11/06 108/92
3,774,774 A * 11/1973 Menkel ..... A47F 7/145 248/152
3,777,897 A * 12/1973 Gray ..... A47F 7/145 211/186
4,164,287 A * 8/1979 Muller ..... A47F 5/116 211/186
4,228,904 A * 10/1980 Dumond ..... A47F 5/112 211/73
4,801,023 A * 1/1989 Ecclestone ..... A47F 7/144 D6/678.3
5,289,926 A * 3/1994 Lewis ..... A47F 5/112 40/124
5,413,801 A * 5/1995 McIlwain ..... A47G 19/00 248/176.1
5,429,296 A * 7/1995 Southwell ..... B65D 5/2009 229/168
5,649,663 A * 7/1997 Pestow, Jr. ..... B65D 5/0045 229/174
5,692,445 A * 12/1997 Winer ..... A47F 5/16 108/100
5,727,857 A * 3/1998 Smith ..... A47F 3/0404 312/351.3
5,915,571 A * 6/1999 Czalkiewicz ..... A47F 7/145 211/128.1
D426,402 S * 6/2000 Rutledge ..... D6/678.2
6,105,796 A * 8/2000 Buchanan ..... A47F 5/116 186/59
6,533,120 B1 * 3/2003 Csengeri ..... B65D 5/5021 220/575
6,655,056 B1 * 12/2003 Wolf ..... G09F 1/10 40/124
6,942,108 B2 * 9/2005 Wons ..... A47F 7/145 211/128.1
7,111,743 B1 * 9/2006 Moss ..... A47F 5/116 211/130.1
7,128,000 B2 * 10/2006 Mummert ..... A47F 7/0071 108/92
8,408,451 B2 * 4/2013 Adam ..... B65D 5/6608 229/222
8,720,689 B2 * 5/2014 Kirkland ..... B65D 43/0202 206/488
9,009,997 B1 * 4/2015 Kemp ..... A47F 7/146 40/124
9,339,128 B2 * 5/2016 Hawkins ..... A47F 3/142
D761,659 S * 7/2016 Schlief ..... D9/636
D901,980 S * 11/2020 Walper ..... D7/551.1
D907,441 S * 1/2021 Walper ..... D7/551.1
11,389,013 B2 * 7/2022 Walper ..... A47F 7/145
11,849,866 B2 * 12/2023 Walper ..... A47F 7/0071
2003/0136310 A1 * 7/2003 Bouffard ..... A47B 96/02 108/92
2004/0251223 A1 * 12/2004 Moss ..... A47F 5/116 211/149
2005/0139561 A1 * 6/2005 Ohkubo ..... A47F 5/0062 211/186
2006/0260979 A1 * 11/2006 Lutes ..... B65D 5/5246 206/768
2012/0187025 A1 * 7/2012 Bowman ..... B65D 5/48044 206/756
2013/0319963 A1 * 12/2013 Coon ..... B65D 5/22 493/51
2014/0210326 A1 * 7/2014 Ceballos Godefroy .. A47F 5/10 312/262
2015/0047297 A1 * 2/2015 Carroll ..... B65D 5/5028 53/410
2016/0168842 A1 * 6/2016 Merrick ..... B23K 31/02 52/741.2
2018/0086495 A1 * 3/2018 Nikolic ..... B65D 5/24
2020/0205585 A1 * 7/2020 Walper ..... A47F 7/145
2021/0120977 A1 * 4/2021 Durand ..... A47F 5/0025
2024/0237835 A1 * 7/2024 Walper ..... A47F 7/145

* cited by examiner

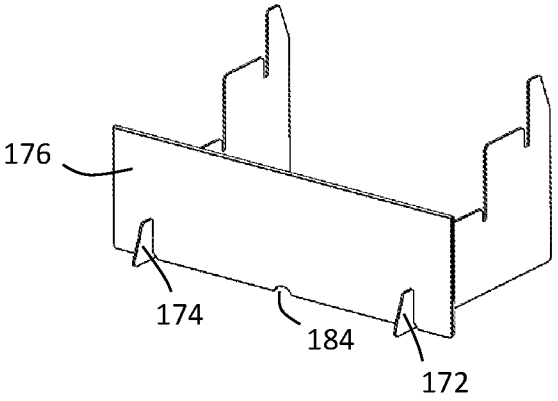
Fig. 40
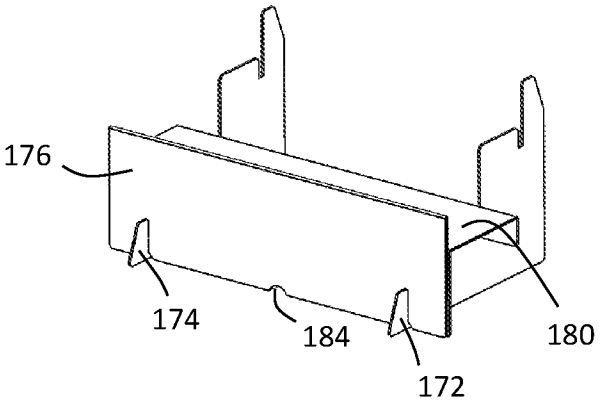
Fig. 41
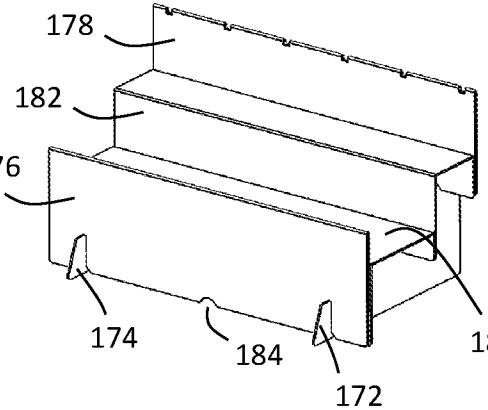
Fig. 42
Fig. 43
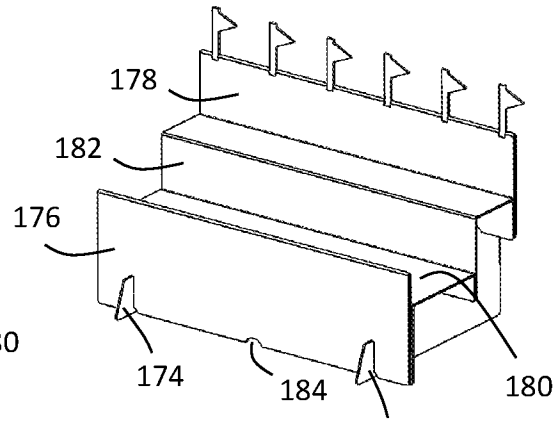
Fig. 44

SERVING STADIUM

CROSS-REFERENCE TO RELATED APPLICATIONS

This application claims the benefit of U.S. patent application Ser. No. 17/868,019 filed Jul. 19, 2022, and issued as U.S. Pat. No. 11,849,866 on Dec. 26, 2023 and U.S. patent application Ser. No. 16/730,148 filed Dec. 30, 2019, and issued as U.S. Pat. No. 11,389,013 on Jul. 19, 2022 and U.S. Provisional Application 62/786,516 filed Dec. 30, 2018, which are each hereby incorporated by reference in their entirety.

TECHNICAL FIELD

The present invention relates to easily and quickly constructing shelving, racks, fixtures, endcaps, stands, structures or other implements, such as to effortlessly and swiftly construct and deconstruct a serving stadium having a tiered structure for displaying food and other items in an aesthetically pleasing manner.

BACKGROUND

Food, containers and other items may be displayed or otherwise presented to facilitate consumption, sales, advertising, etc., such as by positioning the items on shelving, racks, fixtures, endcaps, stands, structures or other implements. It can be advantageous to present the items in an aesthetically pleasing manner and even more advantageous to do so easily and quickly at a low-cost and in a manner whereby the attendant infrastructure occupies a small footprint when deconstructed for transportation. One non-limiting aspect of the present invention contemplates achieving these and other advantages with a food serving stadium or other structure commensurate with the description herein.

BRIEF DESCRIPTION OF THE DRAWINGS

FIGS. 40-54 panels for a shortened, center section in accordance with one non-limiting aspect of the present invention.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
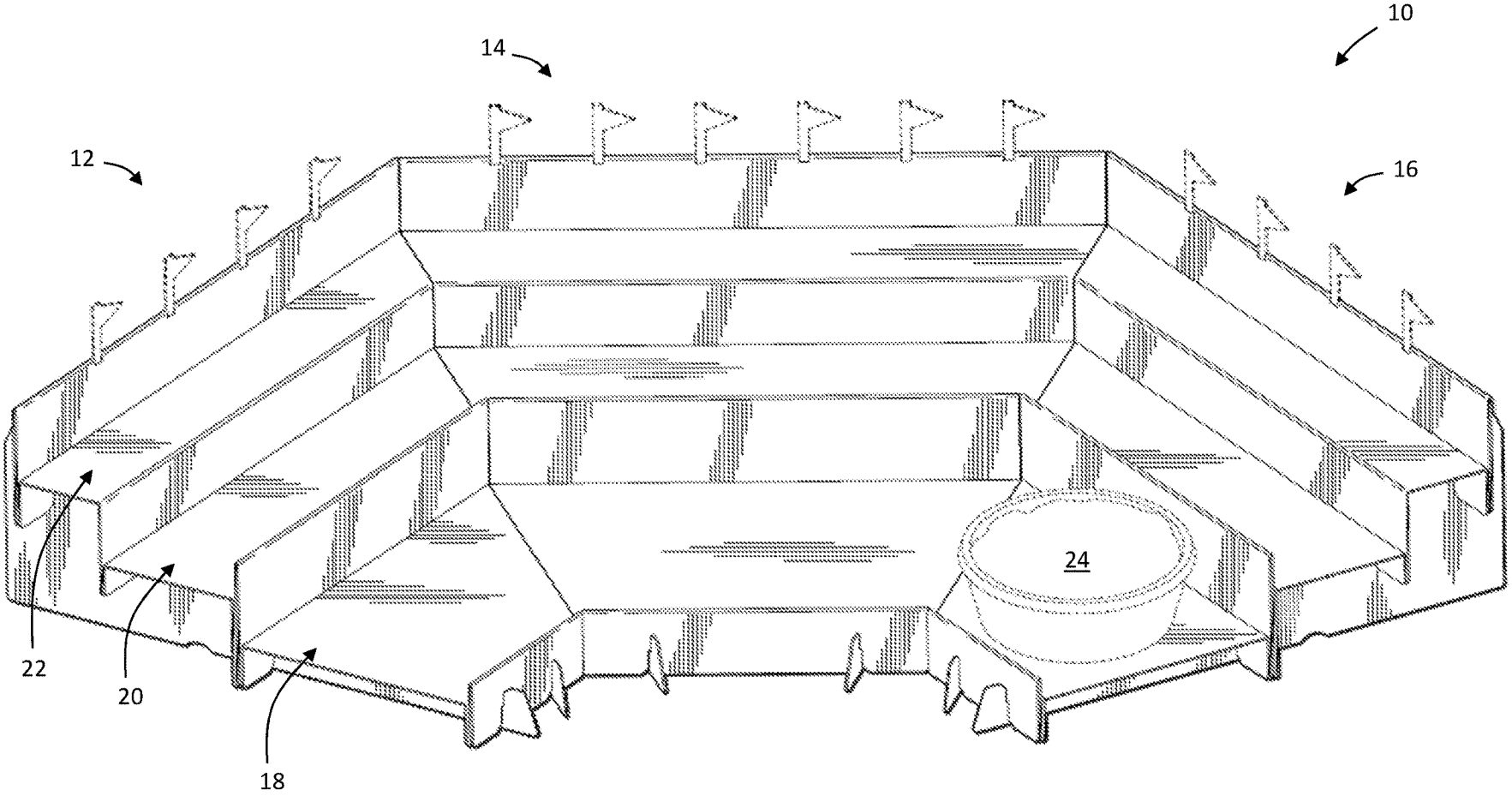
FIG. 1 illustrates a system for displaying items in accordance with one non-limiting aspect of the present invention.

FIG. 1 illustrates a system 10 for displaying items in accordance with one non-limiting aspect of the present invention. The system 10 may be formed in various shapes, sizes and configurations and is predominately described for exemplary purposes as having multiple sections 12, 14, 16 arranged as a tiered stadium similar to a seating area of a sports venue. The tiered-stadium configuration may provide multiple tiers or rows 18, 20, 22 for displaying food and/or other items, such as the illustrated container 24, in an aesthetically pleasing manner to facilitate displaying items at grocery stores, parties, tailgates and other events according to a sports-themed presentation. The stadium 10 may be sized and shaped to facilitate placement on top of a vehicle tailgate, a folding table, an endcap in a grocery store or other structure so that the items can be arranged in a stairstep or ascending manner from front to back. The elevational differentiation of the stadium 10 may be beneficial in enabling items stored farther back to be more easily seen and accessed by a person standing in front than if the same items had been displayed co-planar or at the same elevation as items at the front.

Figure 2:
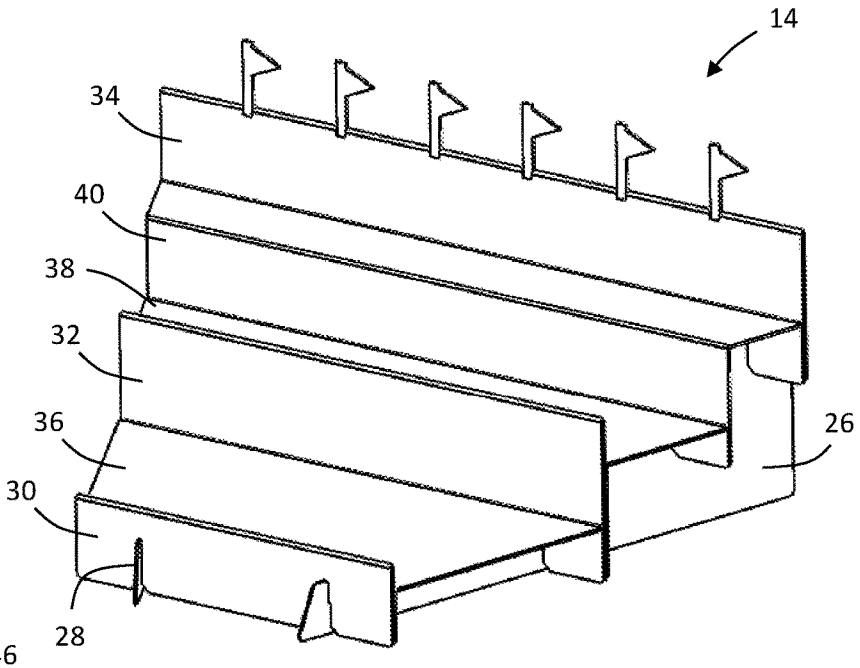
FIGS. 2-17 illustrate panels for a center section in accordance with one non-limiting aspect of the present invention.
Figure 3:
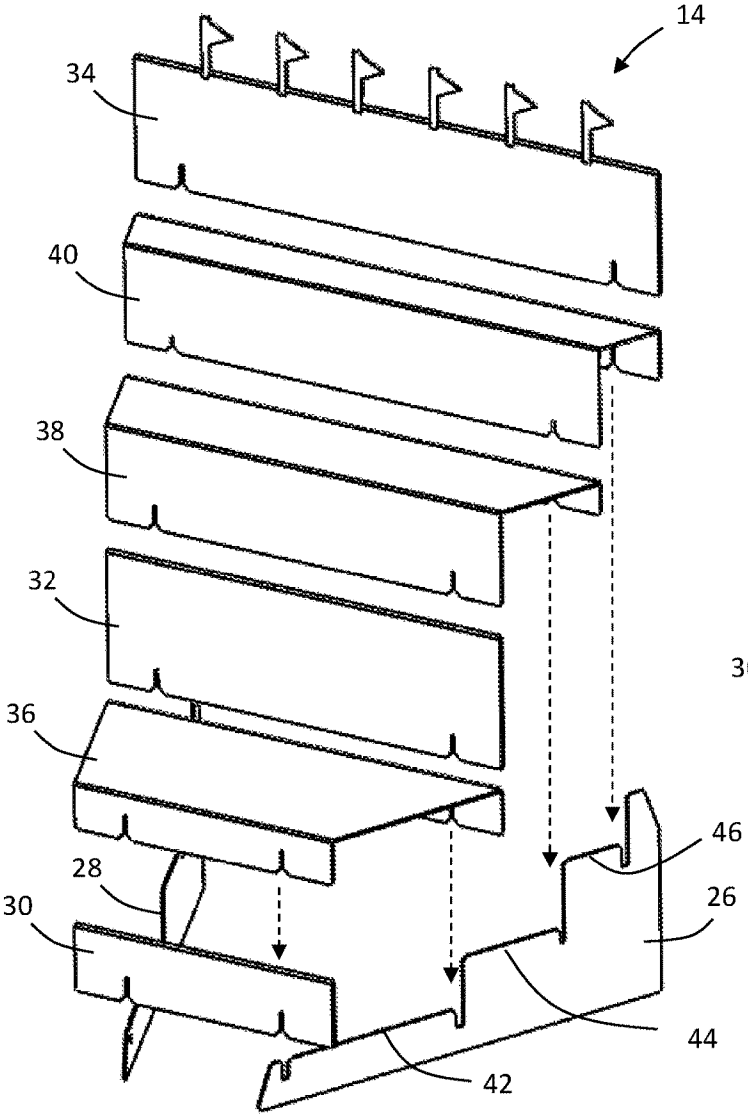
Figure 5A:
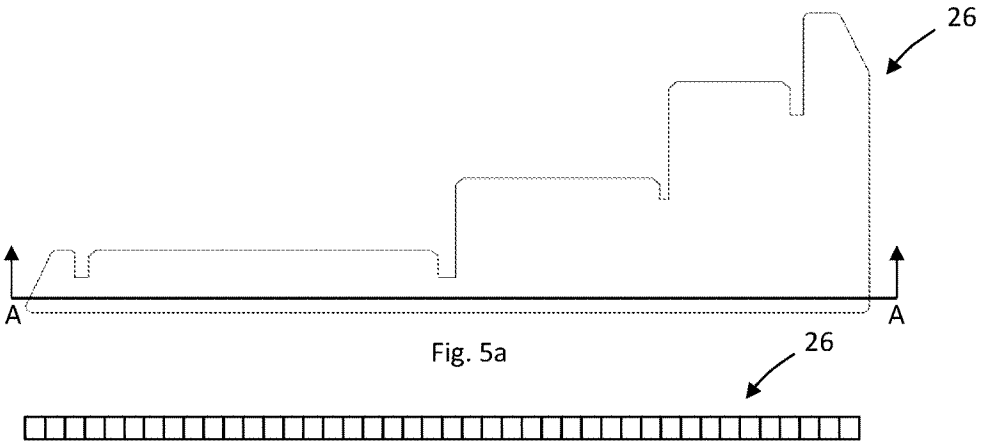
Figure 4:
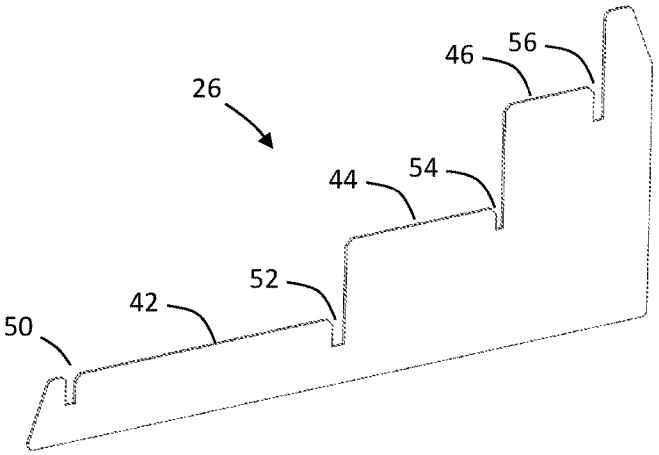

FIGS. 2-3 illustrate a center section 14 of the three sections 12, 14, 16 including a plurality of stringers 26, 28, risers 30, 32, 34 and runners 36, 38, 40. The stringers 26, 28 may have a stairstep shape characterized by a plurality of plateaus 42, 44, 46 being arranged in an ascending manner along a top side for removably supporting the vertically orientated risers 30, 32, 34 and the horizontally orientated runners 36, 38, 40. FIGS. 4-5*b* illustrates one of the stringers 26 shown in FIGS. 2-3 (stringers may be identical). The stringer 26 may include slots 50, 52, 54, 56 on the top side to facilitate orientating the risers 30, 32, 34 and the runners 36, 38, 40 when fitted therein. The slots 50, 52, 54, 56 may optionally include lead-in chamfers or angles slightly wider than the remaining portion to facilitate guiding the risers 30, 32, 34 and runners 36, 38, 40. The stringer 26 may be composed of corrugated plastic, fluted polypropylene, cardboard, fiberboard or other, preferably food-quality, material di-cut or formed, stamped or otherwise processed into the illustrated configuration. FIG. 5*b* illustrates a cross-sectional view of the stringer 26 where hollow cavities forming an internal structure thereof between spacers (vertical lines), which may be referred to as flutes, can be seen as being vertically aligned to maximize fore-aft structural integrity relative to the if the flutes being horizontally aligned.

Figure 7A:
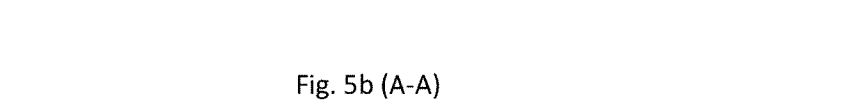
Figure 7A:
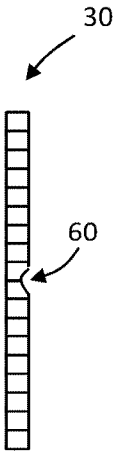
Figure 7A:
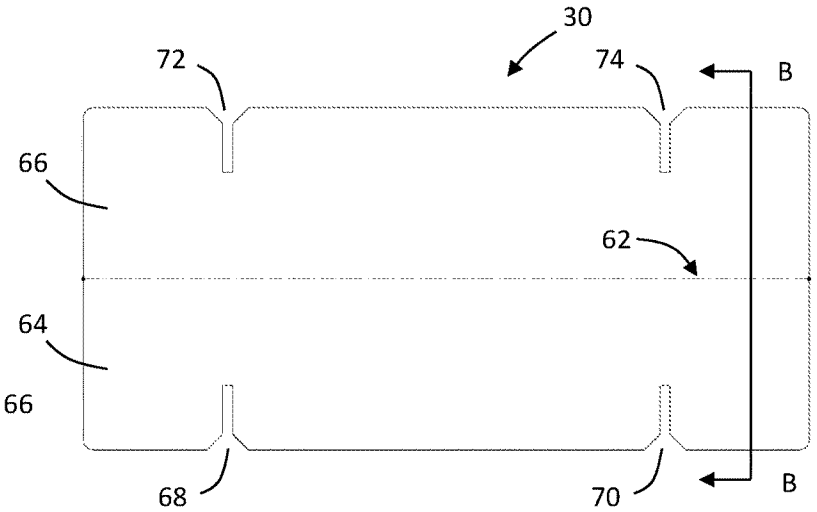
Figure 6:
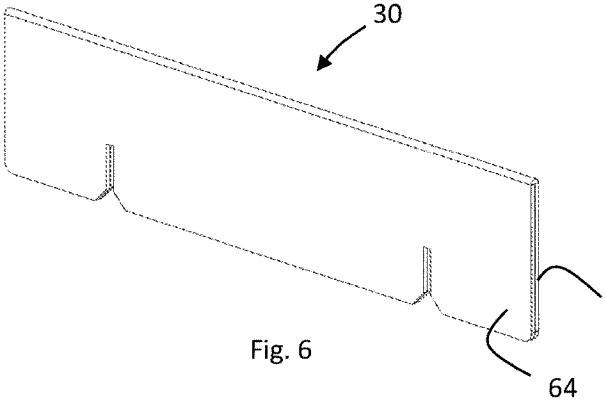

FIGS. 6-7*b* illustrates a lower riser 30 of the plurality of risers 30, 32, 34 included in the center section 14. The riser 30 may be constructed of material similar to that of the stringer 26 but with the internal flutes being horizontally aligned from left to right to maximize lateral-structural integrity. The riser 30 may include an indent or other structural manipulation 60, such as a perforation, to demarcate a middle fold 62 widthwise between lateral sides. The middle fold 62 may be used to facilitate folding such that a forward side 64 and a rearward side 66 adjoin when folded and flex outwardly when positioned in the stringers 26, 28. While the riser 30 may be constructed without use of a fold or alternatively with a folding or extruding machine, one non-limiting aspect of the present invention contemplates folding the riser by hand where use of the fold 62 may be beneficial in guiding a user to the proper folding position. While the present invention contemplates the riser 30 having a singular layer like the stringers 26, 28, the double-layered arrangement resulting from the folding may be beneficial due to its improved structural integrity over a single layer. The riser 30 may include channels 68, 70 on a forward end and channels 72, 74 on a rearward end to facilitate journaling within corresponding the stringers 26, 28. The present invention fully contemplates securing the risers 30, 32, 34 within the stringers 26, 28 without the channels or with use of other alignment features, including the use of removable and/or non-removable fasteners and adhesives.

Figure 9:
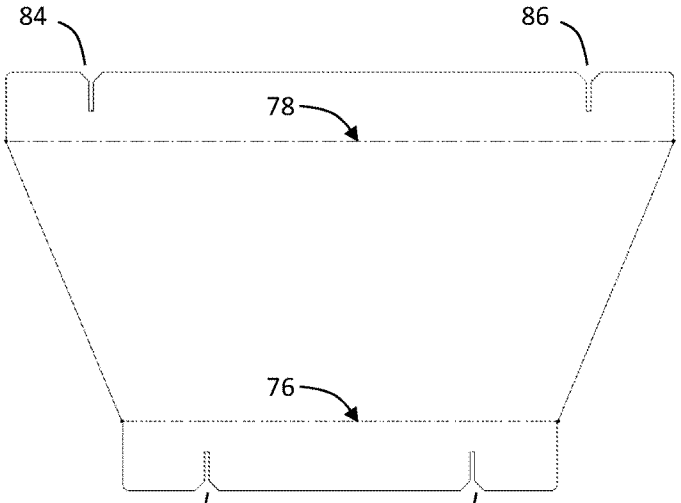
Figure 11:
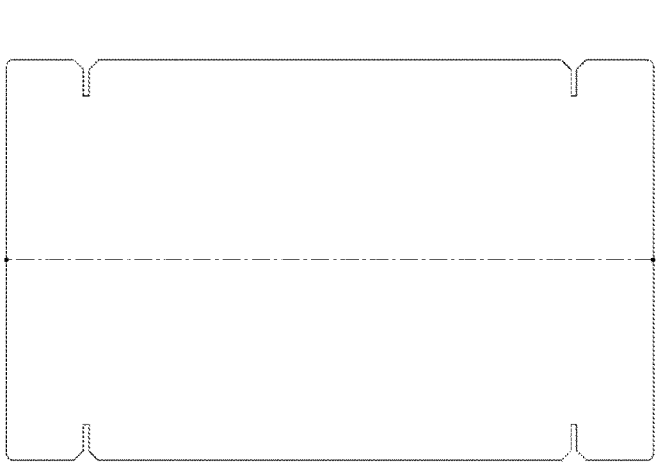
Figure 8:
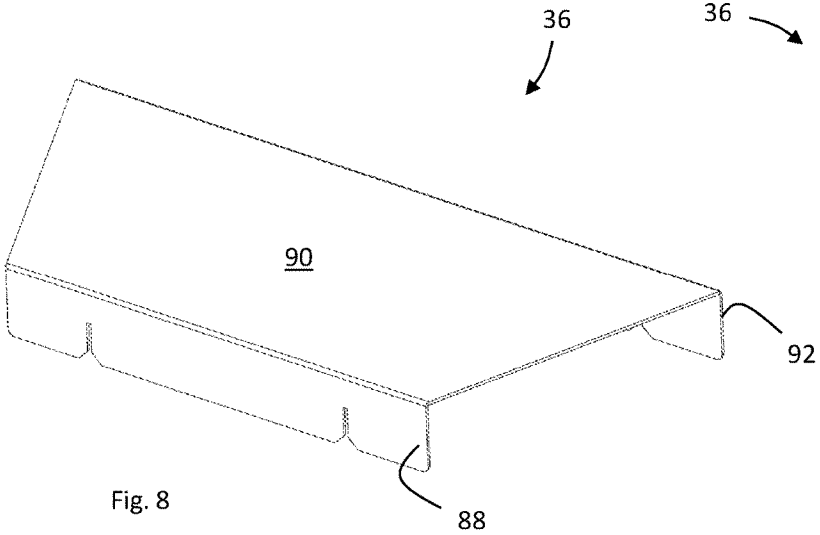
Figure 10:
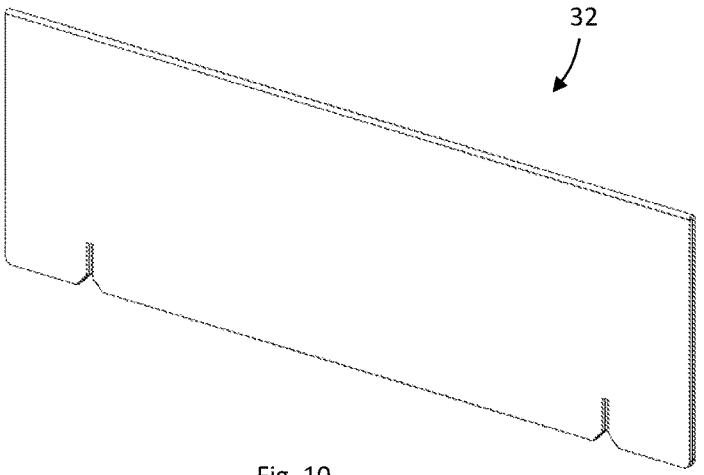
Figure 13:
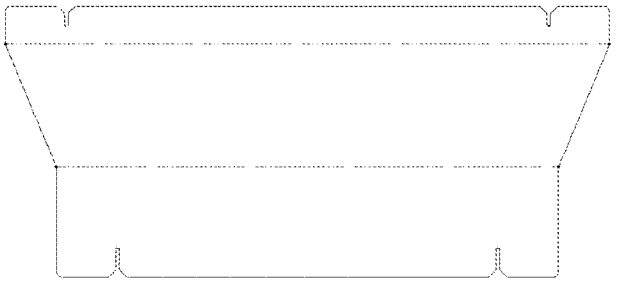
Figure 12:
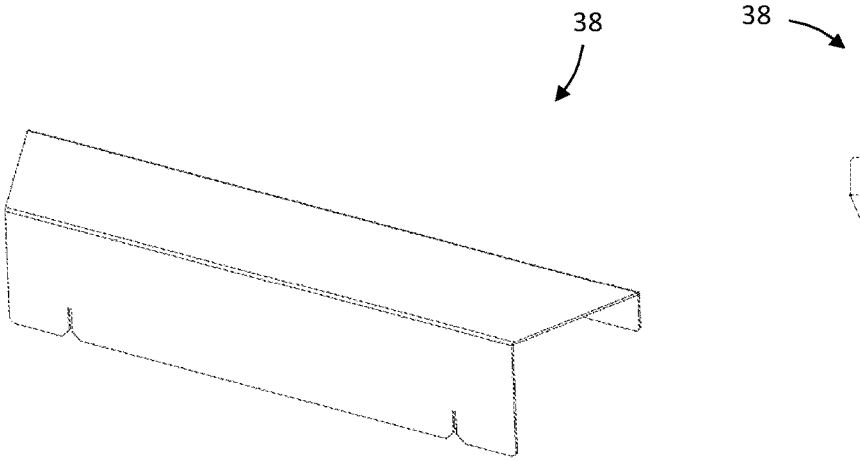
Figure 15:
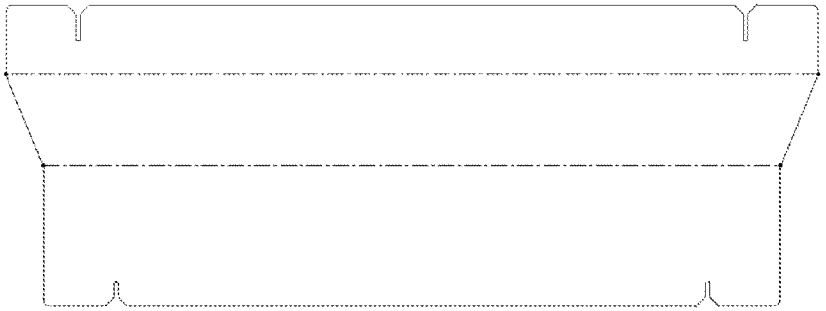
Figure 14:
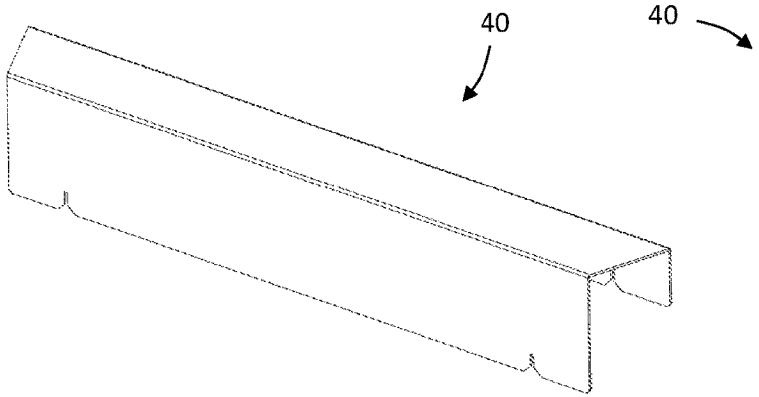
Figure 16:
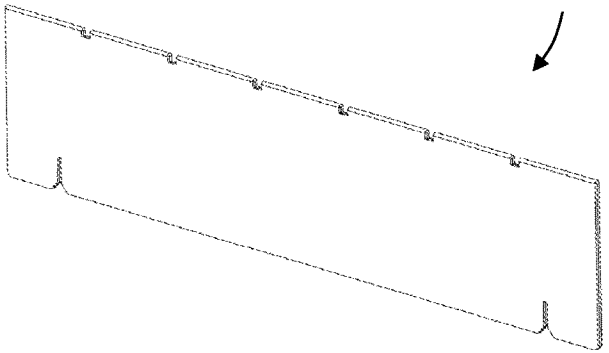
Figure 17:
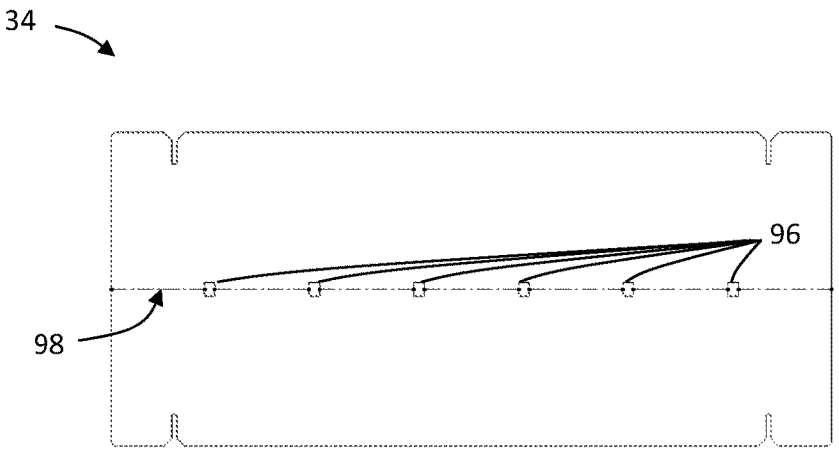
Figure 19:
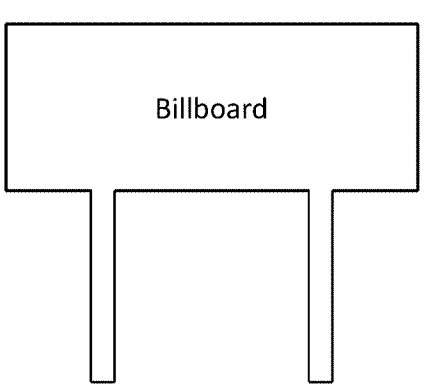
FIGS. 18-19 respectively illustrate a flag and a billboard in accordance with one non-limiting aspect of the present invention.
Figure 18:
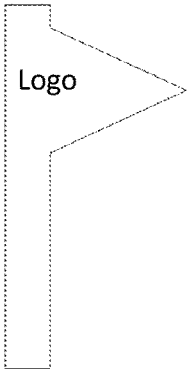

FIGS. 8-9 illustrate a lower runner 36 of the plurality of runners 36, 38, 40 included in the center section 14. The runner 36 may be constructed similarly to the riser 30 insofar as having a similar material composition, forward fold 76, a rearward fold 78, forward reliefs 80, 82 and rearward reliefs 84, 86 to facilitate positioning within the stringers. The runner 36 may include a forward portion 88 folding vertically downward, a trapezoidal shaped horizontal portion 90 for supporting items and a rearward portion 92 folding vertically downward. FIGS. 10-11 illustrate a middle riser 32 of the plurality of risers 30, 32, 34 included in the center section 14. FIGS. 12-13 illustrate a middle runner 38 of the plurality of runners 36, 38, 40 included in the center section 14. FIGS. 14-15 illustrate an upper runner 40 of the plurality runners 36, 38, 40 included in the center section 14. FIGS. 16-17 illustrate an upper riser 34 of the plurality risers 30, 32, 34 included in the center section 14, which may optionally include a plurality of apertures 96 along a middle fold 98 for receiving items therein. FIGS. 18-19 respectively illustrate a flag 100 and a billboard 102 as exemplary signage capable of being inserted within the apertures 96 for advertising or other purposes, such as to provide lettering for comments, helmets for sporting teams, flowers, etc. While not illustrated, stickers, adhesive logos or non-adhesive attachment mechanisms may be utilized to facilitate additional message conveyance.

Figure 21:
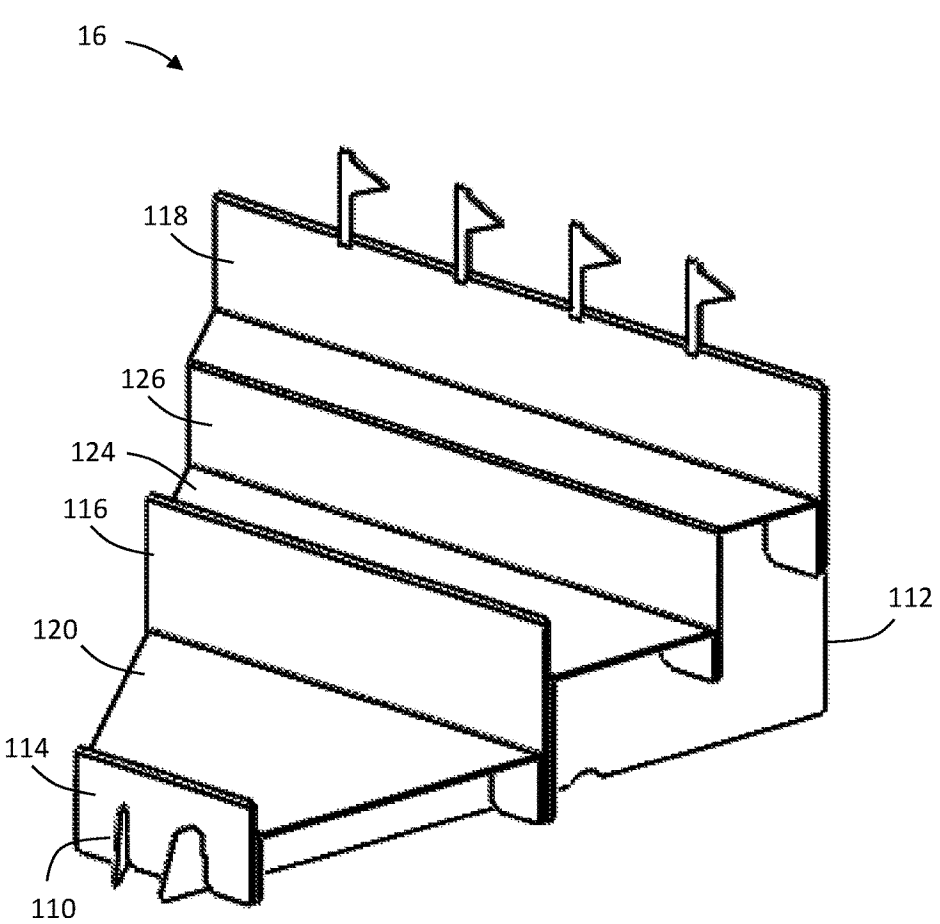
FIGS. 20-35 illustrate panels for a side section in accordance with one non-limiting aspect of the present invention.
Figure 20:
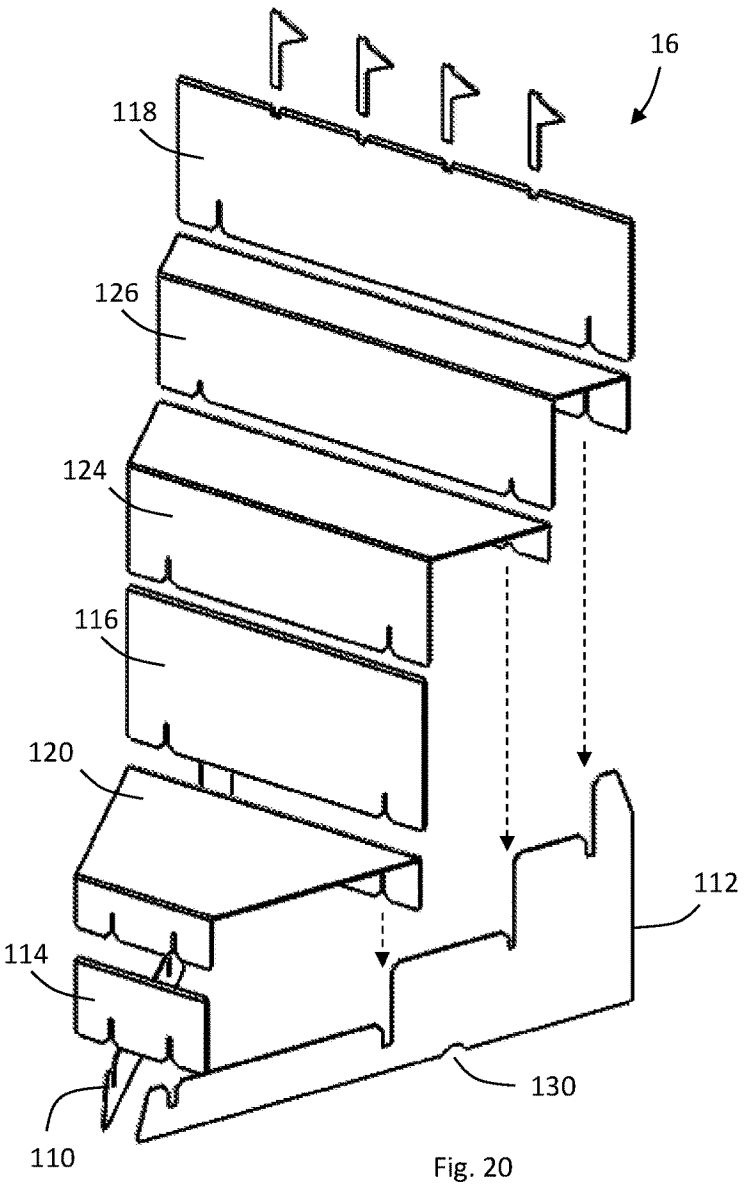
Figure 23:
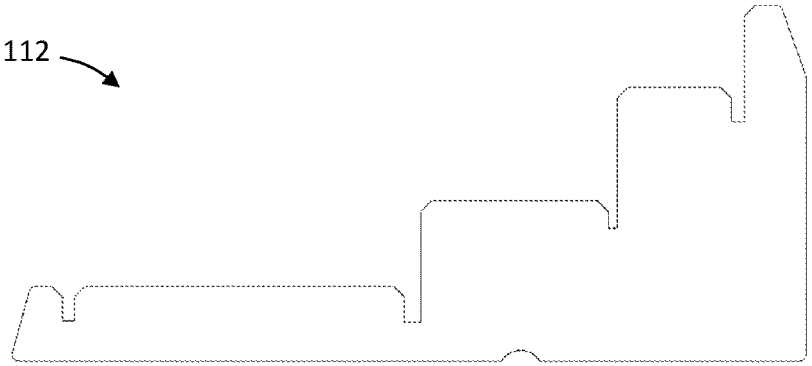
Figure 25:
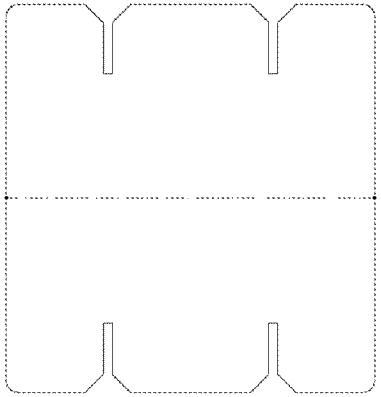
Figure 22:
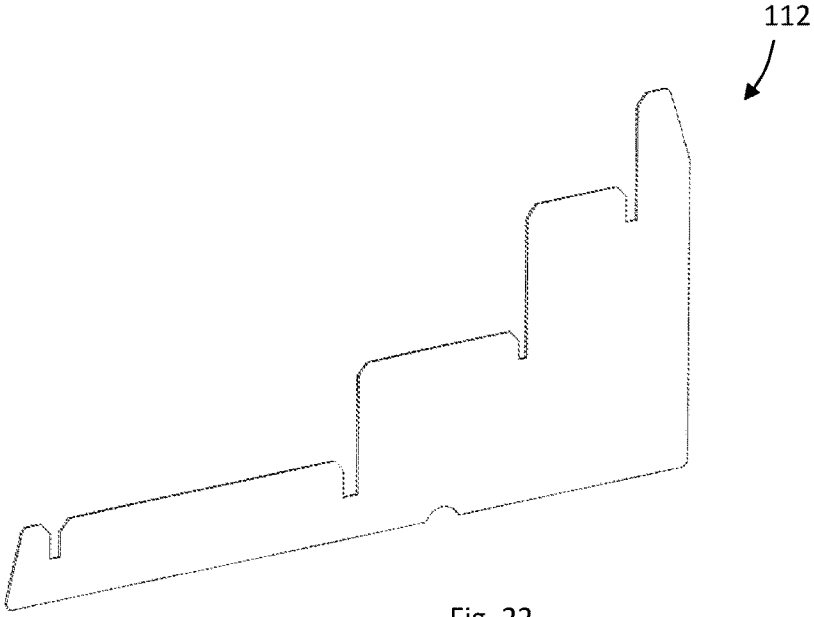
Figure 24:
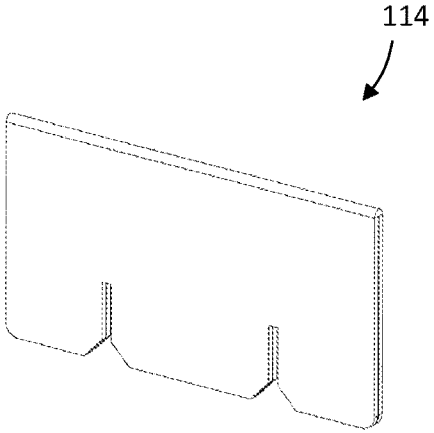
Figure 27:
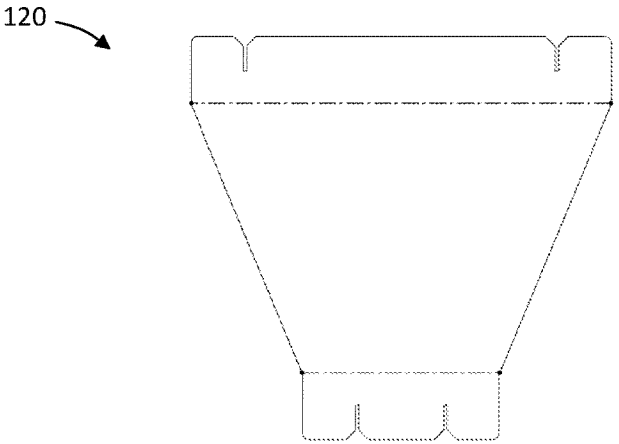
Figure 29:
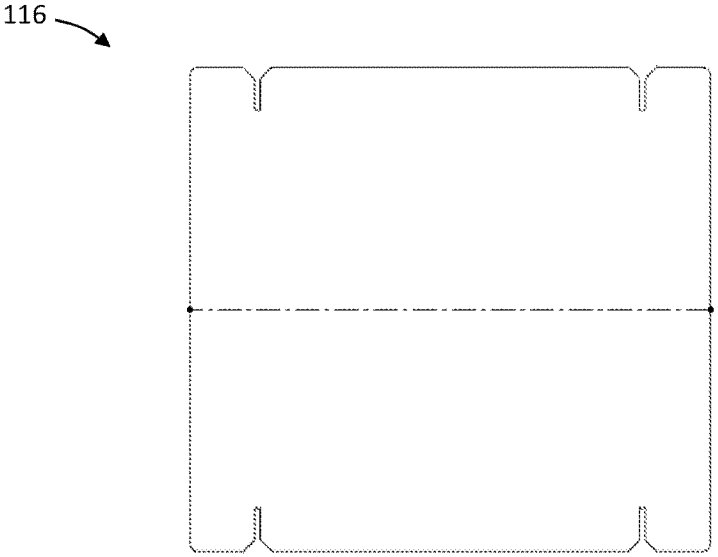
Figure 26:
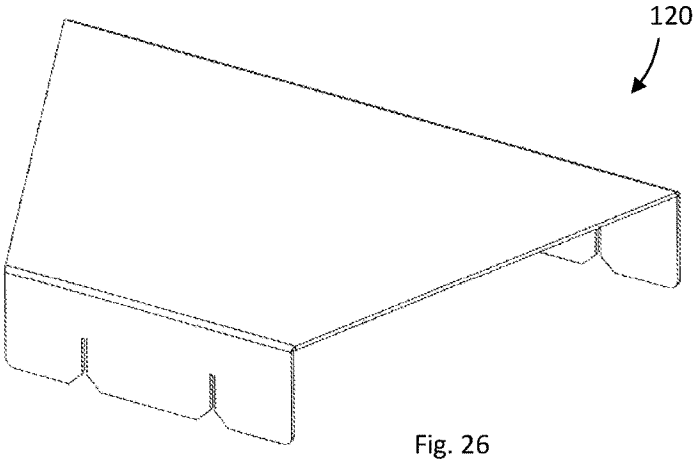
Figure 28:
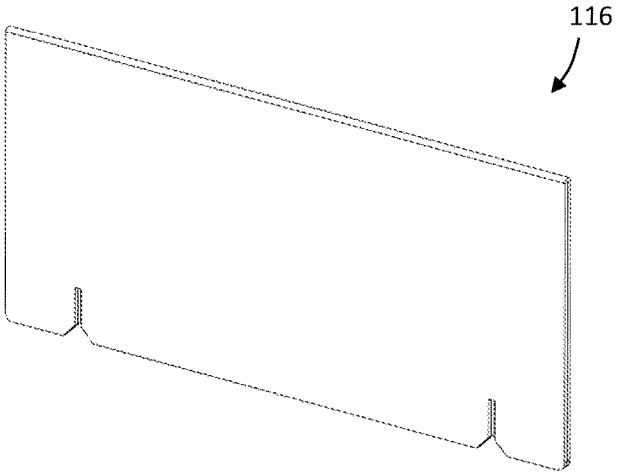
Figure 31:
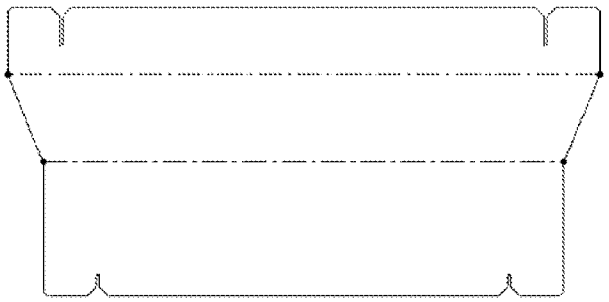
Figure 33:
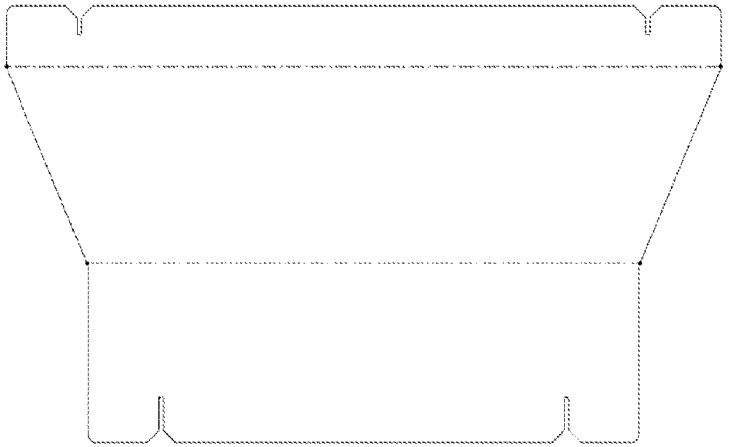
Figure 30:
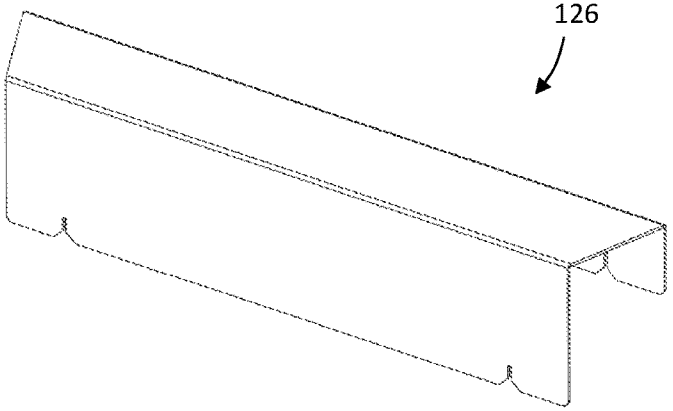
Figure 32:
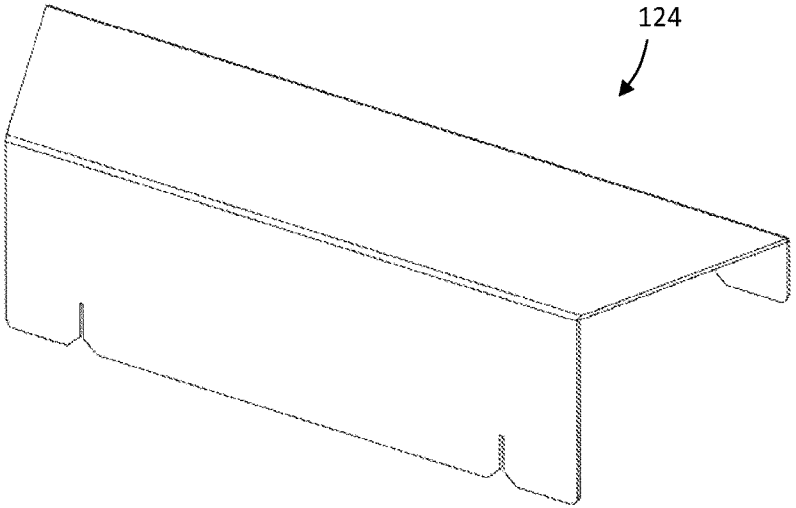
Figure 35:
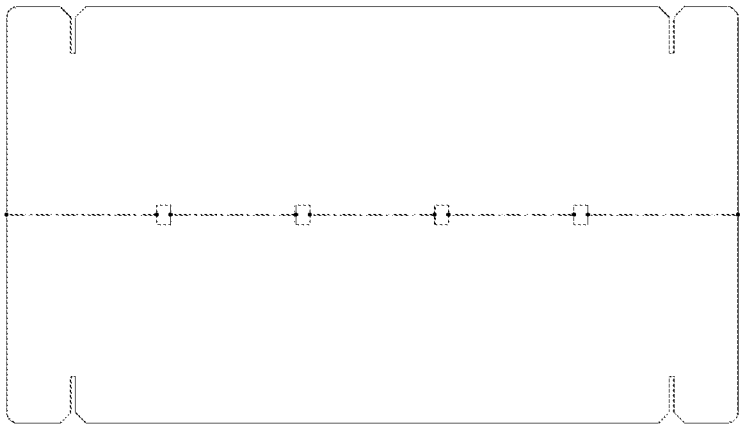
Figure 34:
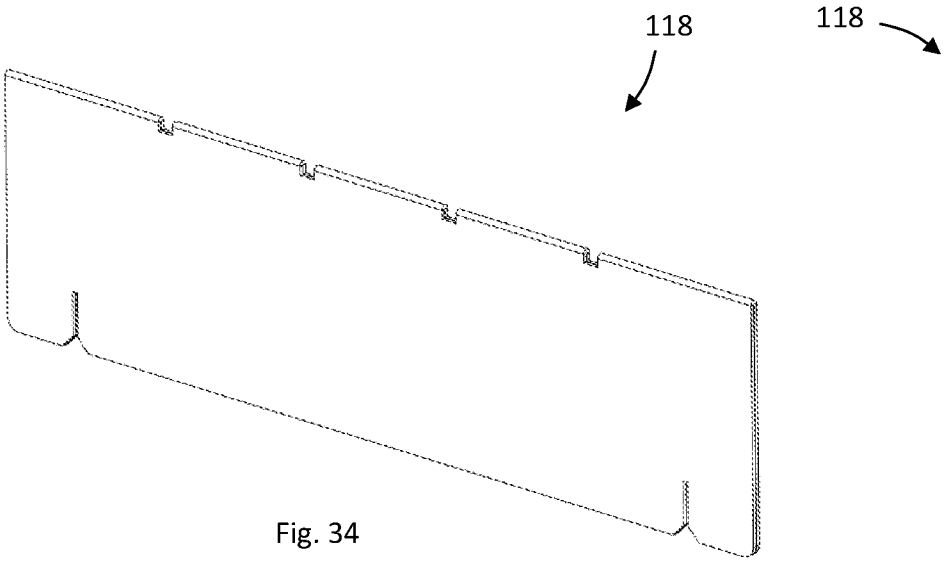

FIGS. 20-21 illustrates a side section 16 of the three sections 12, 14, 16, which may be constructed similarly to the center section 14 using a plurality of stringers 110, 112, a plurality of risers 114, 116, 118 and a plurality of runners 120, 124, 126. FIGS. 22-35 illustrates one of the stringers 112, the risers 114, 116, 118 and the runners 120, 124, 126 interconnecting to form the side section. As shown in FIGS. 22-23, the stringer went 12 may include an identifier 130, such as a swoop, to facilitate differentiating it from the stringers 26, 28 of the center section 14, which may be beneficial in facilitating construction and deconstruction. One non-limiting aspect of the present invention contemplates a low-cost structure capable of being easily and quickly constructed and deconstructed to facilitate displaying items in an aesthetically pleasing manner. The stadium can described above may be so constructed from panels or blanks of corrugated or other materials whereby the individual panels, i.e., the planar form of the stringers, risers and runners, maybe stacked upon each other and shipped within a box having a relatively small footprint. A salesperson or partygoer can then open the box and fold each of the planar pieces into the stringers, risers and runners for easily and quickly setting up the stadium.

The stadium 10 is shown to include three sections 12, 14, 16 for exemplary purposes as the stadium 10 may be constructed using more or less sections, such as by using two side sections, one side section and one center section or multiple center and side sections. The stadium 10 is illustrated with the sections 12, 14, 16 being relatively sized and positioned at 22.5° to demonstrate one manner of construction believed to be particularly beneficial for use with a 30"×6' table or truck tailgate. The stadium 10 may be beneficial in such environments due to the relative size enabling it to occupy most of the 30" depth while providing room on the table/tailgate forward of the lateral sides of the side sections 12, 14, 16 for positioning plates, glasses, silverware or other objects associated with the items being served. The rows (runners) are illustrated as being successively shorter from fore to aft for exemplary purposes in order to demonstrate one non-limiting aspect of the present invention whereby larger items may be placed on the lower rows in order to be closer to a user whereas smaller items may be placed on the upper rows due to those items potentially being of less interest or easier to lift. The three rows are illustrated for exemplary non-limiting purposes as the present invention fully contemplates the stringers 26, 28 being shaped to form more or less rows having different rise-run, pitch line, rise height and/or tread depth.

Figure 36:
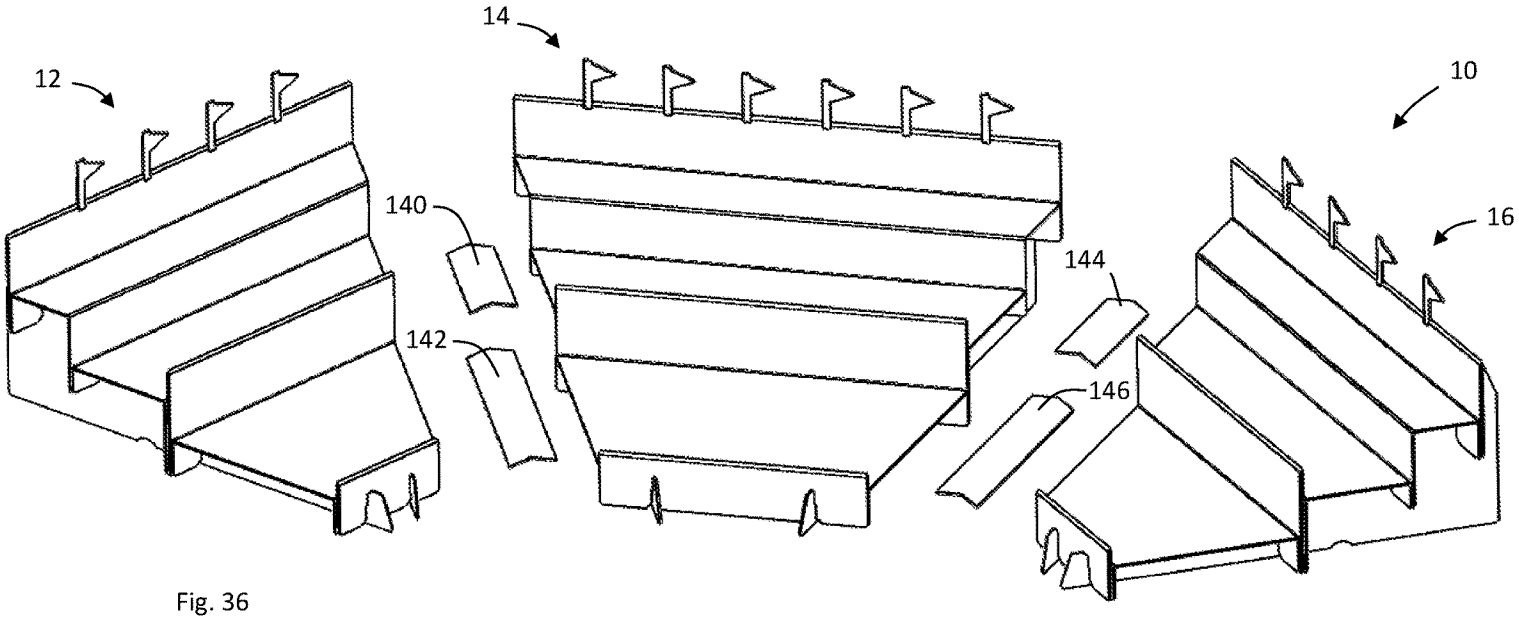
FIGS. 36-37 illustrate a plurality of covers in accordance with one non-limiting aspect of the present invention.
Figure 37:
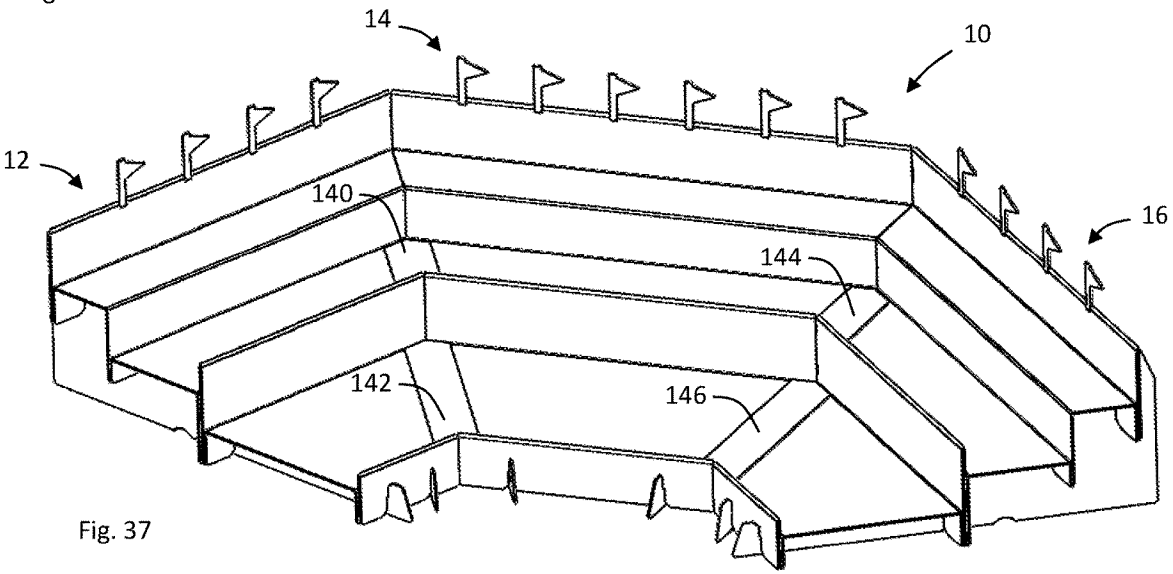
Figure 38:
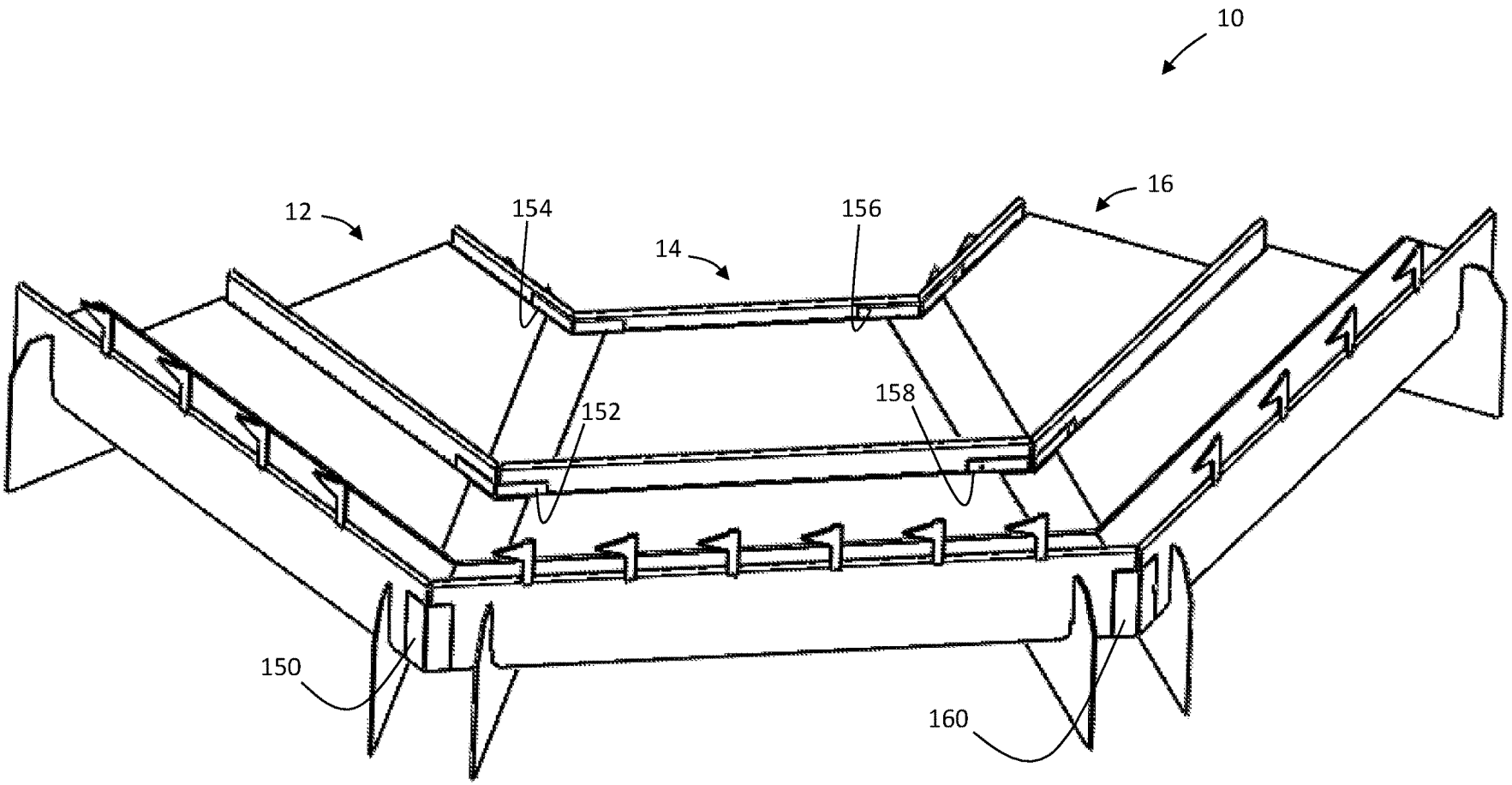
FIG. 38 illustrates a plurality of straps in accordance with one non-limiting aspect of the present invention.

FIGS. 36-37 illustrate a plurality of covers 140, 142, 144, 146 that may optionally be included to facilitate covering seams in the lower and middle rows between the sections 12, 14, 16. The covers 140, 142, 144, 146 may be attached with adhesives and/or fasteners and are shown for exemplary purposes as being held in position without use of adhesives or fasteners. The covers 140, 142, 144, 146 may be held in position fore and aft with the vertical surfaces provided by the lower and middle risers and the upper runner and further held in lateral position using forward and rearward angled portions shaped to match angling of the sections 12, 14, 16. The angled portions may interact with the corresponding sectional pieces to help restrain lateral movement of the sections, i.e., the angled portion may grab/pinch the sectional pieces to restrain movement. The covers 140, 142, 144, 146 are omitted from the upper row for exemplary purpose due to the upper row omitting a forward, vertical surface for restraining a cover, however, covers could be included for the upper row with use of other securement mechanisms. FIG. 38 illustrates a plurality of straps 150, 152, 154, 156, 158, 160 that may optionally be included to attach between adjoining ones of the three sections to limit movement. The straps 150, 152, 154, 156, 158, 160 may be Velcro strips having adhesive portions individually attached to the sections 12, 14, 16 and a gripping portion that removably spans to adjoined adhesive portions to facilitate limiting movement.

Figure 39:
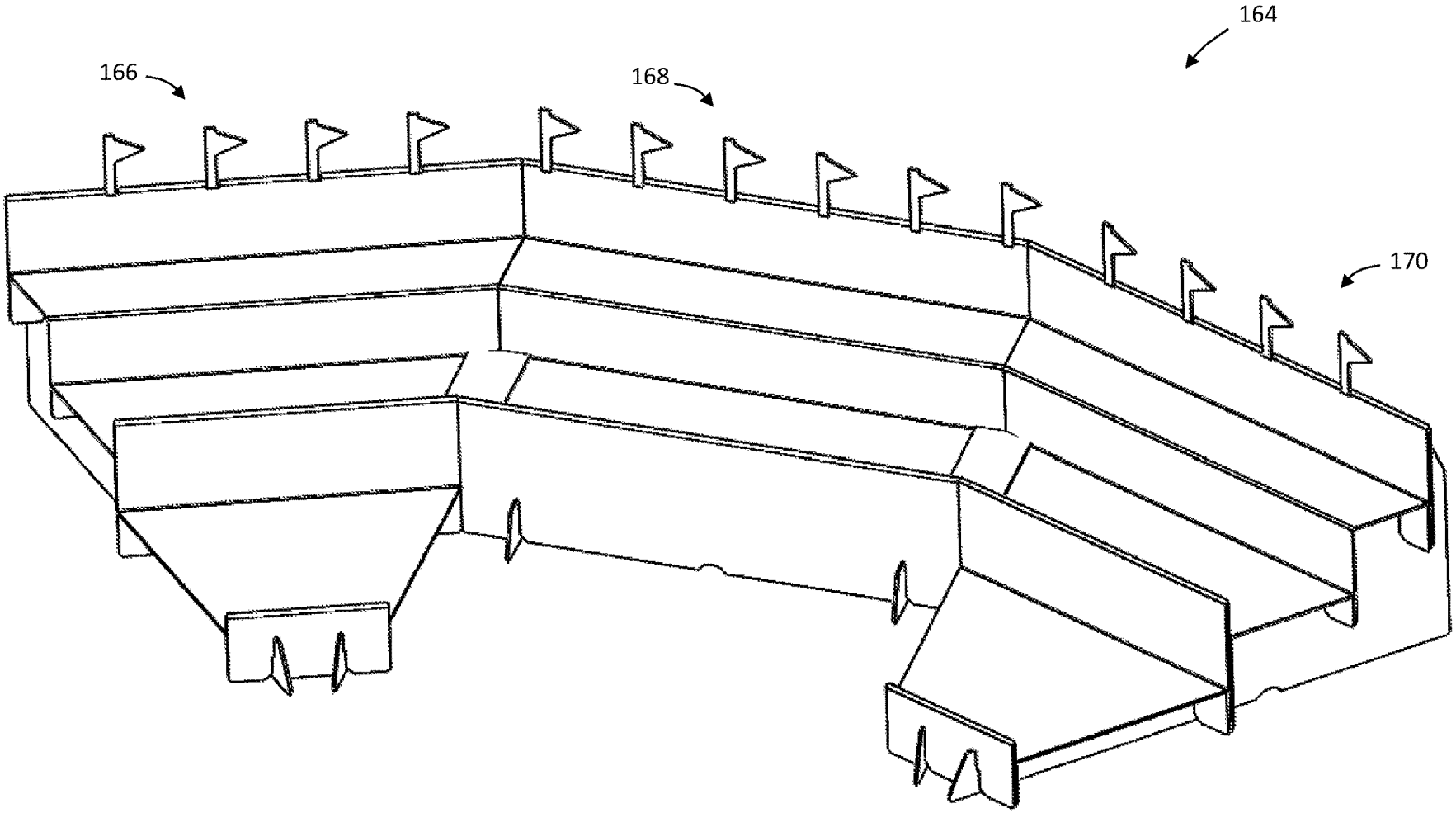
FIG. 39 illustrates a center stadium in accordance with one non-limiting aspect of the present invention.
Figure 46:
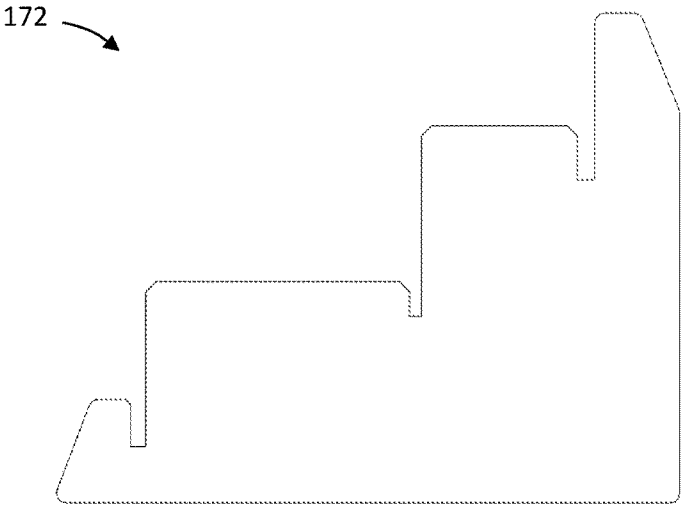
Figure 48:
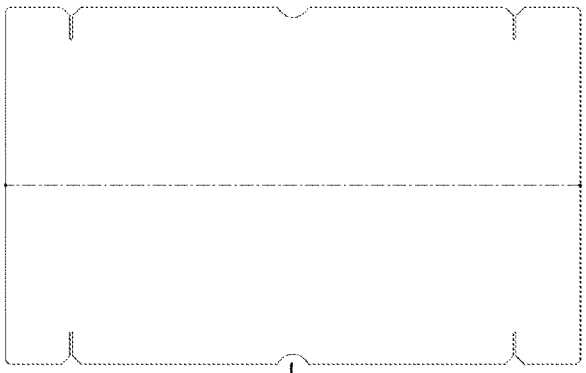
Figure 45:
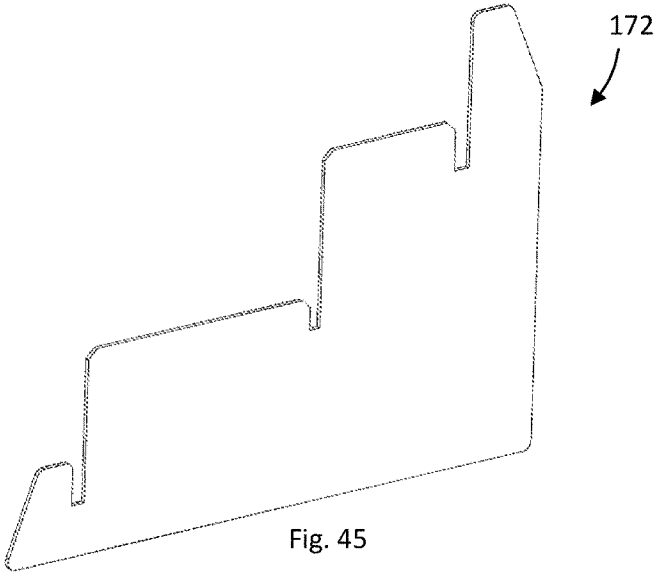
Figure 47:
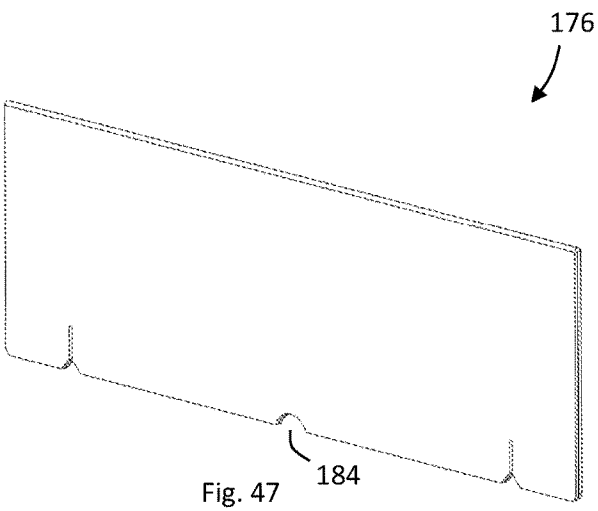
Figure 50:
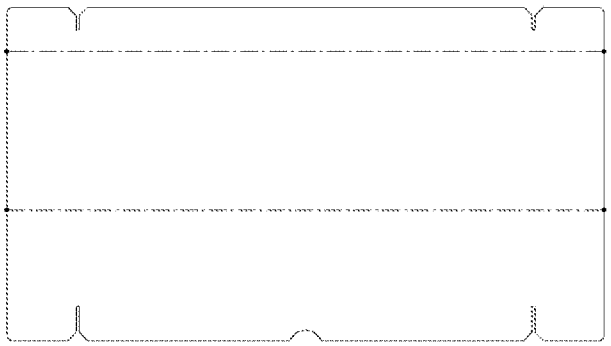
Figure 52:
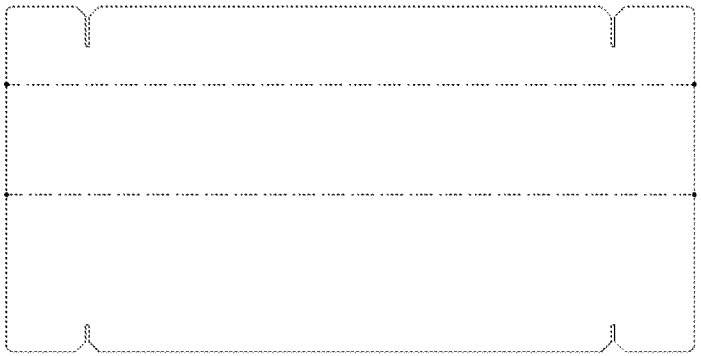
Figure 49:
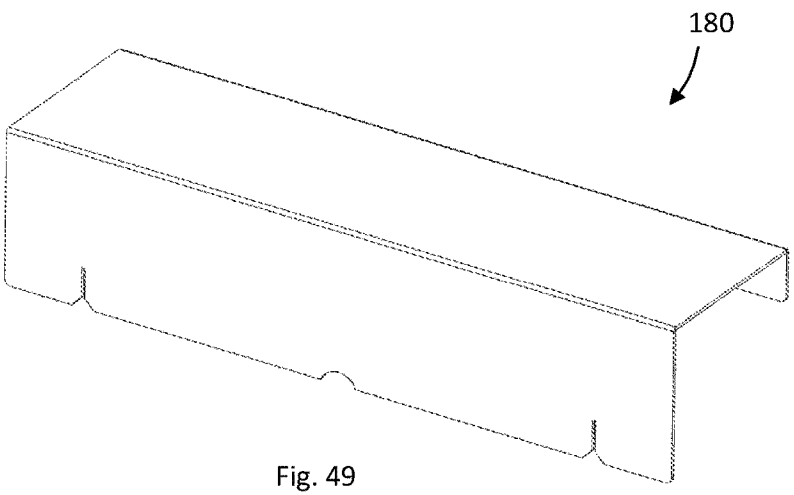
Figure 51:
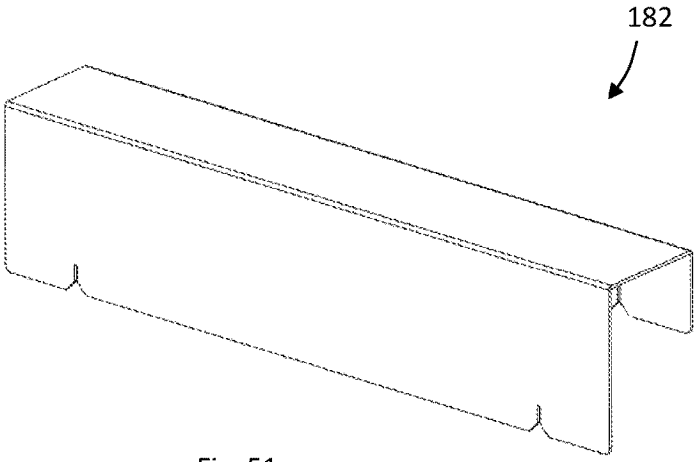
Figure 54:
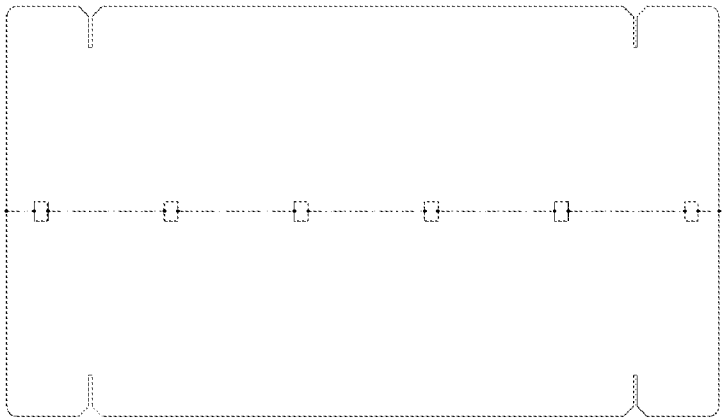
Figure 53:
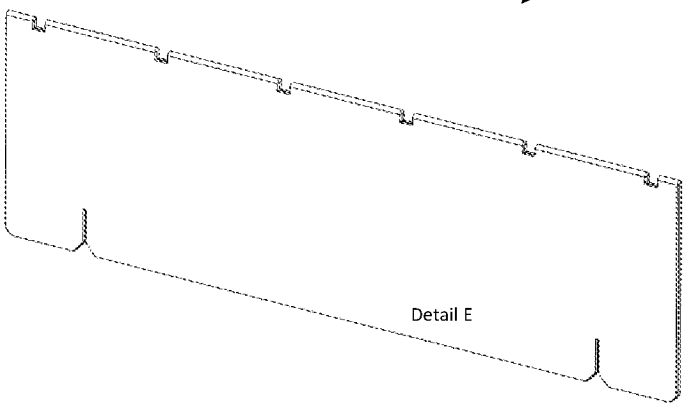

FIG. 39 illustrates a center stadium 164 in accordance with one non-limiting aspect of the present invention. The center stadium 164 may include three sections 166, 168, 170 similar to the stadium described above but with a center section 168 being shorter, i.e., the center stadium 164 may be comprised of the two of the above-described side sections and a shorter, center section 168. FIGS. 40-54 illustrate the plurality of stringers 172, 174, a plurality of risers 176, 178 and a plurality of runners 180, 182 comprising the shortened, center section 168 to facilitate forming the center stadium 164. A lower riser 176 and a lower runner 180 are shown to include an opening 184 to facilitate feeding a power cord under the center stadium, such as to power a crockpot or other electronically operable item positioned in front of the shortened, center section 168. The center stadium 164 illustrates one of a number of configurations contemplated by the present invention to facilitate serving items. The center stadium 164 may be similarly fashioned from planar panels and quickly and easily constructed and deconstructed by hand folding and putting together the stringers 172, 174, the risers 176, 178 and the runners 180, 182 to facilitate swift and effortless use.

Figure 55:
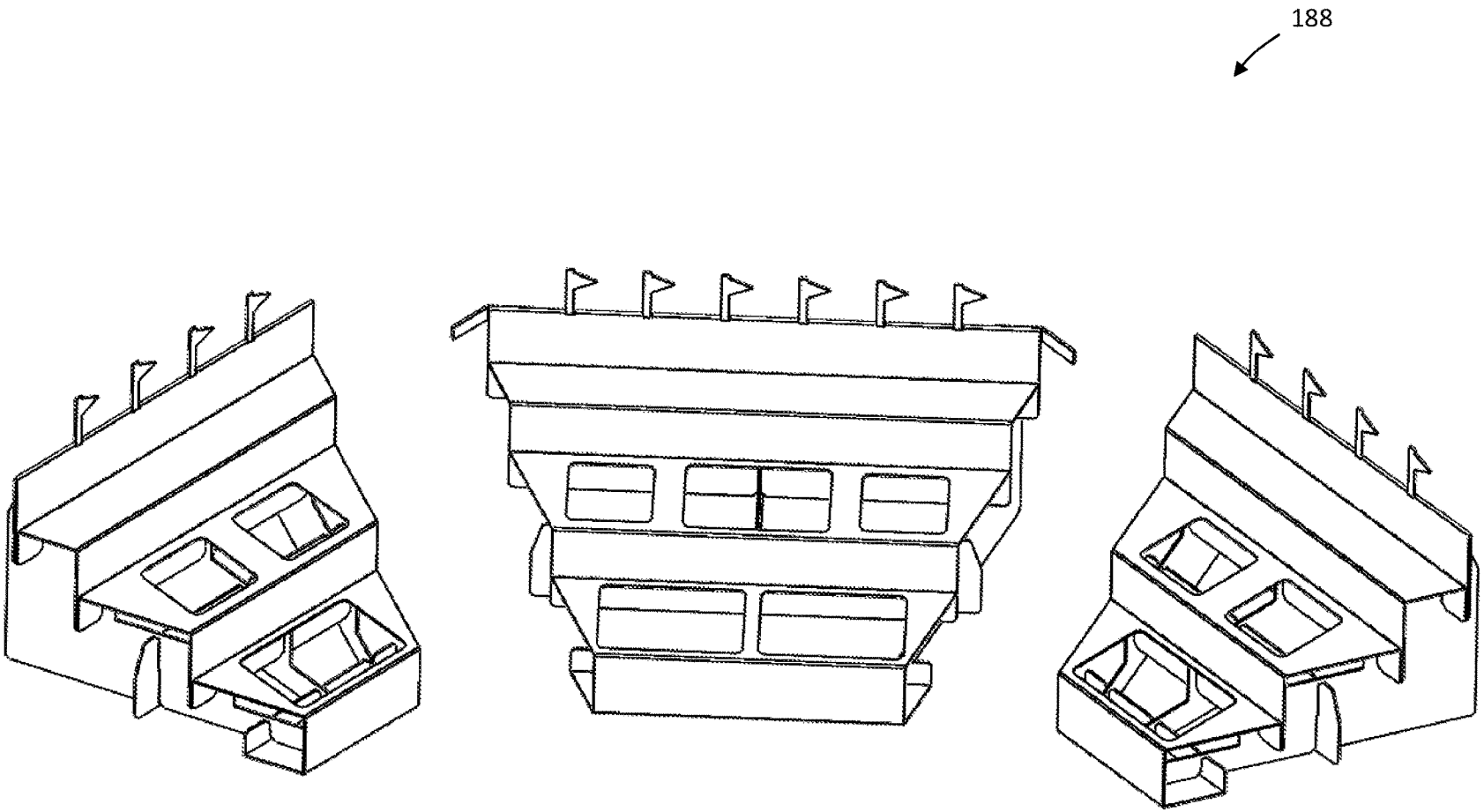
FIG. 55 illustrates a receptacle stadium in accordance with one non-limiting aspect of the present invention.
Figure 56:
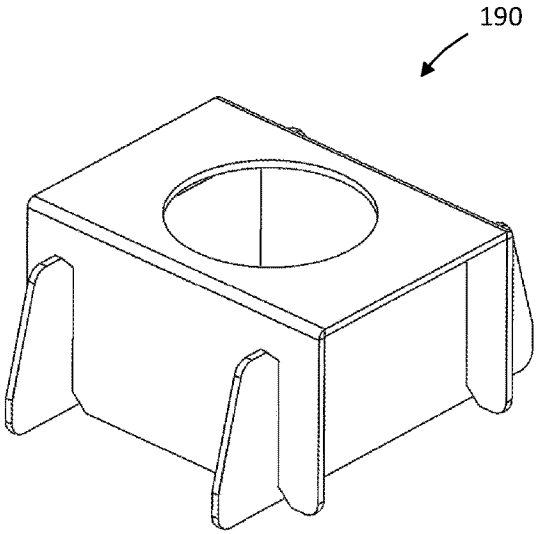
FIGS. 56-60 illustrate a cup holder in accordance with one non-limiting aspect the present invention
Figure 60:
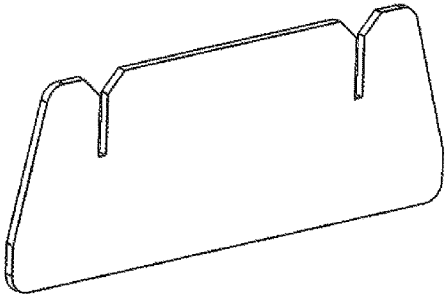
Figure 57:
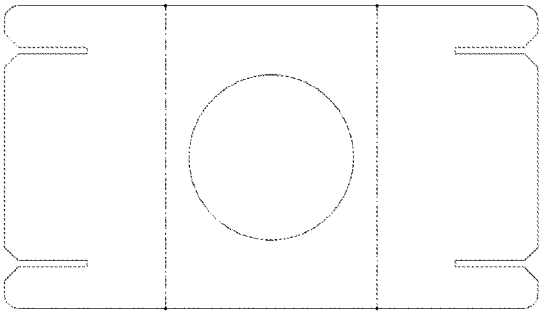
Figure 58:
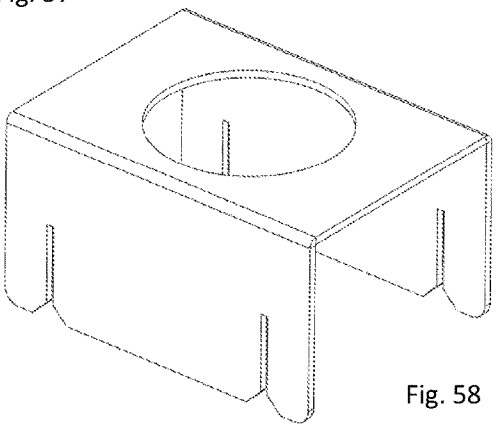
Figure 59:
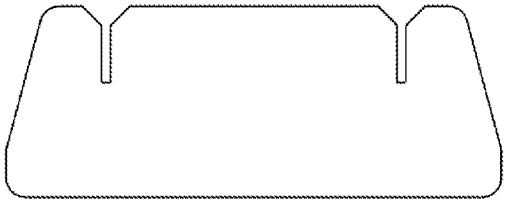
Figure 61:
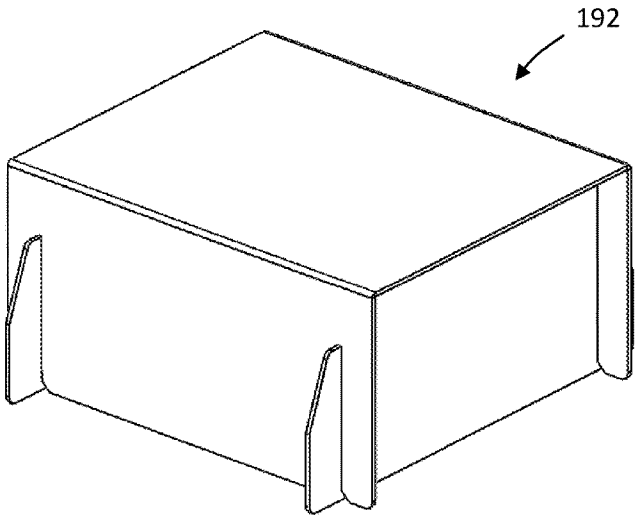
FIGS. 61-65 illustrate a table in accordance with one non-limiting aspect of the present invention.
Figure 62:
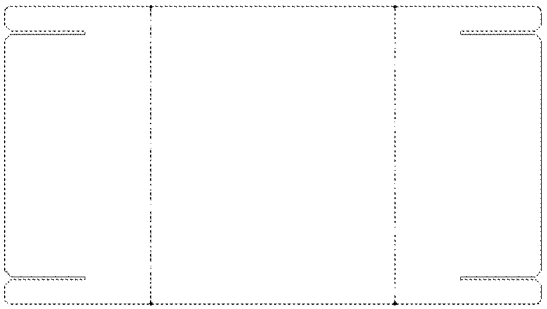
Figure 63:
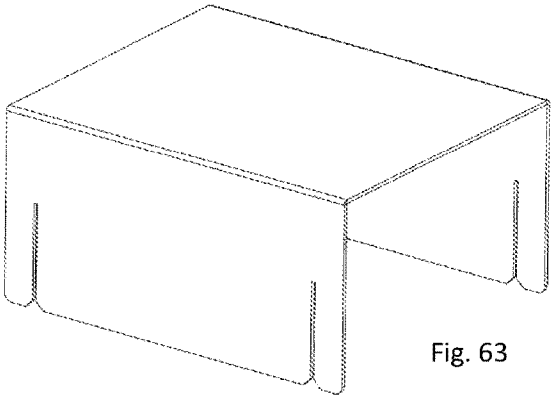
Figure 64:
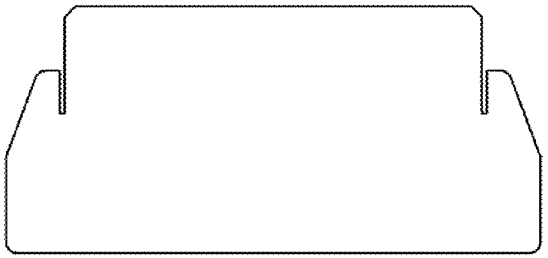
Figure 65:
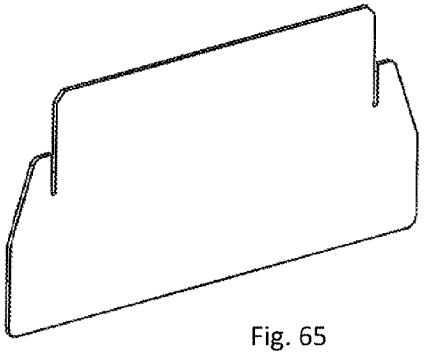
Figure 66:
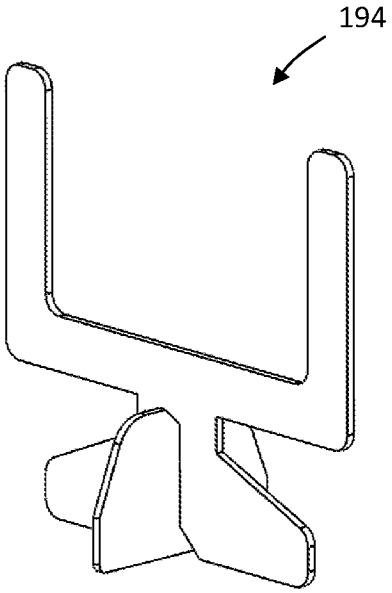
FIGS. 66-70 illustrate a goal post in accordance with one non-limiting aspect of the present invention
Figure 68:
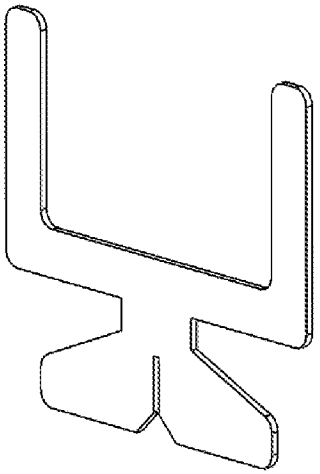
Figure 70:
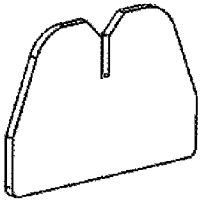
Figure 67:
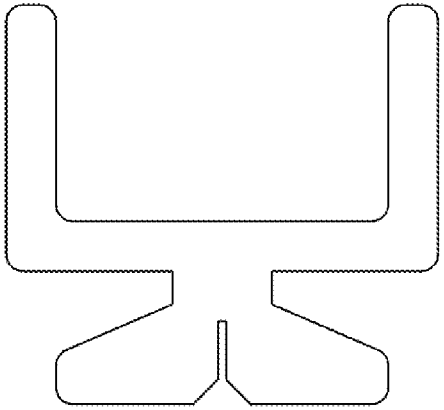
Figure 69:
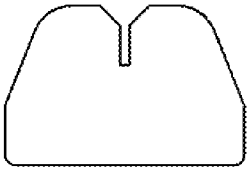

FIG. 55 illustrates a receptacle stadium 188 in accordance with one non-limiting aspect of the present invention. The receptacle stadium 188 may be constructed similarly to the other stadiums but with a portion of the runners including apertures for receiving containers, packaging or other receptacle such that a portion of the receptacle extends below an upper surface of the runners. FIGS. 56-60 illustrate a cup holder 190 in accordance with one non-limiting aspect the present invention. FIGS. 61-65 illustrate a table 192 in accordance with one non-limiting aspect of the present invention. FIGS. 66-70 illustrate a goal post 194 in accordance with one non-limiting aspect of the present invention. The cup holder, table and goal post 190, 192 and 194 may be constructed from panels similar to those utilized with the above stadiums by correspondingly cutting the individual panels into the illustrated planar panels and thereafter folding the panels for assembly. The cup holder, table and/or goal post 190, 192 and 194 may be placed on the stadiums and/or beside the stadiums to augment the aesthetic appearance and to provide structures for holding beverage containers or adjusting elevation for side-items.

Each of the stadiums described herein are illustrated for non-limiting purposes with the risers and runners including channels/reliefs relatively spaced to correspondingly widen the stringers fore to aft so as to maximize lateral stability. The positioning of the stringers, particularly the portions extending forward of the lower risers and rearward of the upper risers, is believed to be beneficial in facilitating the stadium appearance. One non-limiting aspect of the present invention contemplates the stadium being low-cost and capable of being quickly and easily constructed and deconstructed. The above-described stadiums may be so constructed from modular, planar elements formed of a relatively low-cost material pre-packaged in a planar orientation within a box having a relatively small footprint whereafter a user can fold and unfold the risers and runners to modularly construct as many of the individual sections as desired. The surfaces of the stringers, runners and risers may be individually colored or designed to enhance the aesthetic appearance, such as by coloring different portions of the stadium to represent colors associated with desired sports teams, coloring matching a theme of a birthday party or graphics and other illustrations related to a product being displayed for sale.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A food serving stadium, comprising:

a plurality of stringers, the stringers each having a plurality of plateaus arranged in an ascending manner from a front to back to provide a stairstep shape along a top side, the front to back defined from a front of the stringers to a back of the stringers;

a plurality of runners, the runners each shaped to removably attach between a two or more of the stringers, wherein each runner is shaped in a horizontal manner to provide a support surface for display of food, wherein each support surface spans from a forward end closer to the front of the stringers to a rearward end closer to the back of the stringers;

a plurality of risers, the rises each shaped to removably attach between a two or more of the stringers in front of a corresponding one of the runners, wherein each riser is shaped in a vertical manner to extend above the forward end of the support surface of the corresponding runner to limit food displayed thereon from sliding forwardly thereof; and wherein the stringers, the runners and the risers combine to provide a tiered-stadium configuration for display of food.

2. The food serving stadium of claim 1 wherein:

the stringers include a plurality of slots along the top side; and the risers and the runners removably fit within the slots.

3. The food serving stadium of claim 2 wherein:

the risers include a plurality of channels spaced apart along each of a forward side and a rearward side;

the runners include a plurality of reliefs spaced apart along each of the forward end and the rearward end; and wherein the channels and the reliefs removably fit within the slots.

4. The food serving stadium of claim 3 wherein:

the risers include a middle fold widthwise between lateral sides; and the runners include a forward fold widthwise between lateral sides and a rearward fold widthwise between lateral sides.

5. The food serving stadium of claim 4 wherein at least one of the plurality of risers includes a plurality of apertures spaced apart along the middle fold.

6. The food serving stadium of claim 5 further comprising a plurality of flags fitted into a corresponding one of the plurality of apertures.

7. The food serving stadium of claim 5 further comprising a billboard, the billboard having a signage area supported on a first leg offset from a second leg, the first and second legs being fitted into corresponding first and second apertures of the plurality of apertures.

8. The food serving stadium of claim 4 wherein the stringers, the risers and the runners are composed of a food-quality material capable of being folded by hand.

9. The food serving stadium of claim 1 wherein each of the plateaus are at an elevation different than each of the other plateaus.

10. The food serving stadium of claim 9 wherein the elevation of each of the plateaus successively increases front to back from the front to the back of the stringers.

11. The food serving stadium of claim 1 wherein the stringers, the risers and the runners combine to define the tiered-stadium configuration with at least three sections.

12. The food serving stadium of claim 11 wherein the stadium configuration includes at least two of the at least three sections being trapezoidal in shape.

13. The food serving stadium of claim 12 wherein at least one of the at least three sections is shorter in depth than one of the other at least three sections.

14. The food serving stadium of claim 11 further comprising a plurality of seam covers covering at least a portion of seams between adjoining ones of the at least three sections.

15. The food serving stadium of claim 11 further comprising a plurality of straps attaching between adjoining ones of the at least three sections to limit movement.

16. A food serving stadium, comprising:

a plurality of panels configured for removably interconnecting to form a tiered stadium for display of food wherein a first plurality of the panels are shaped to form stringers;

wherein a second plurality of the panels are shaped to form runners, with each runner configured to removably interconnect between two or more of the stringers, wherein the runners each define a support surface for display of food; and wherein a third plurality of the panels are shaped to form risers, with each riser configured to removably interconnect between two or more of the stringers in front of a corresponding one of the runners, wherein the risers are each shaped to extend above the support surface of the corresponding runner to limit food displayed thereon from sliding forwardly thereof.

17. The food serving stadium of claim 16 wherein:

the stringers each have a plurality of slots spaced apart along an ascending top side;

the risers fit into and extend from one of the slots on one of the stringers to an aligned one of the slots on another one of the stingers; and the runners:

i) fit at a forward end into and extend from one of the slots on one of the stringers to an aligned one of the slots on another one of the stingers;

ii) fit at a rearward end into and extend from one of the slots on one of the stringers to an aligned one of the slots on another one of the stingers; and iii) include a planar surface between the forward end and the rearward end to provide the support surface for display of food.

18. A serving stadium formed by a process comprising:

forming a plurality of stringers, the stringers each having a plurality of plateaus arranged in an ascending manner from front to back forming a plurality of runners, the runners each shaped to removably fit between a two or more of the stringers, wherein each runner is shaped to provide a support surface for display of food;

forming plurality of risers, the risers each shaped to removably fit between a two or more of the stringers in front of a corresponding one of the runners, wherein each riser is shaped to extend above the support surface of the corresponding runner to limit food displayed thereon from sliding thereof;

positioning the runners and the risers relative to the stringers to produce a tiered stadium for display of food on the support surfaces.

19. The food serving stadium of claim 18 wherein the process further comprises:

forming the risers includes a middle fold widthwise between lateral sides;

forming the runners includes a forward fold widthwise between lateral sides and a rearward fold widthwise between lateral sides; and folding the risers about the middle folds and the runners about the forward and rearward folds prior to positioning the risers and the runners relative to the stringers.

20. The food serving stadium of claim 19 wherein the process further comprises:

forming one or more of the risers to include one or more apertures;

forming a sign having a base sized to fit within one or more of the apertures; and positioning the sign within the riser.

* * * * *